US010046474B2

(12) United States Patent
Levasseur et al.

(10) Patent No.: US 10,046,474 B2
(45) Date of Patent: Aug. 14, 2018

(54) PLANER HEAD

(71) Applicant: DK-Spec Inc., Saint-Nicolas (CA)

(72) Inventors: Clermont Levasseur, St-Antoine de Tilly (CA); Thomas Levasseur, Quebec (CA); Guillaume Aubé, Quebec (CA)

(73) Assignee: Dk-Spec Inc., Saint-Nicolas (CA)

( * ) Notice: Subject to any disclaimer, the term of this patent is extended or adjusted under 35 U.S.C. 154(b) by 846 days.

(21) Appl. No.: 14/453,275

(22) Filed: Aug. 6, 2014

(65) Prior Publication Data

US 2015/0059925 A1 Mar. 5, 2015

Related U.S. Application Data

(60) Provisional application No. 61/872,998, filed on Sep. 3, 2013.

(51) Int. Cl.

| | |
|---|---|
| ***B27C 1/02*** | (2006.01) |
| ***B27G 13/10*** | (2006.01) |
| ***B27G 13/04*** | (2006.01) |

(52) U.S. Cl.

CPC ..... *B27C 1/02* (2013.01); *B27G 13/04* (2013.01); *B27G 13/10* (2013.01)

(58) Field of Classification Search

CPC ..... B27G 13/00; B27G 13/02; B27G 13/04; B27G 13/06; B27G 13/08; B27G 13/10; B27G 13/12; B27C 1/02; B27C 1/04; B27C 1/005; B27C 1/14; B02C 18/00; B02C 18/02; B02C 18/04; B02C 18/06; B02C 18/062; B02C 18/18; B02C 18/182; B02C 18/184; B02C 18/186; B02C 18/188; B02C 18/20; B02C 18/26; B02C 18/362; A01G 23/083; B27L 1/10

See application file for complete search history.

(56) References Cited

U.S. PATENT DOCUMENTS

2010/0189519 A1* 7/2010 Kerf ..... B02C 18/186 407/47

2015/0306604 A1* 10/2015 Domer ..... B05B 7/0408 241/294

FOREIGN PATENT DOCUMENTS

WO WO 2006098647 A1 * 9/2006 ..... B27C 1/14

* cited by examiner

*Primary Examiner* — Matthew G Katcoff

(74) *Attorney, Agent, or Firm* — Mintz Levin Cohn Ferris Glovsky and Popeo, P.C.; Steven M. Jensen

(57) ABSTRACT

A planer head includes a cylindrical body having a first end, a second end and a crenelated curved face extending therebetween and including a plurality of pockets receiving a plurality of knives and knife holders. A clamping assembly connects each of the plurality of knife holders to their corresponding knives by frictional engagement. The clamping assembly includes at least one pair of clamping elements, each being disposed on a corresponding one of the first and second ends of the body. When moved in the longitudinal direction toward each other, the at least one pair of clamping elements forcing the plurality of knife holders in the radial direction thereby engaging in friction the knife holders with their corresponding knives and knife pockets of the body. A number of pairs of clamping elements is lower than a number of at least one of knives and knife holders. A kit for a planer head assembly, a clamping assembly, and a planer body are also presented.

26 Claims, 28 Drawing Sheets

PLANER HEAD

CROSS-REFERENCE TO RELATED APPLICATION

This application claims the benefit of and priority to previously-filed U.S. provisional patent application No. 61/872,998, filed Sep. 3, 2013, the contents of which are hereby incorporated by reference.

BACKGROUND

To manufacture plain wood lumbers, freshly cut wood logs undergo a series of transformations. Typically, the bark is first removed, then the cross-section of the wood log is transformed from a rounded shape to a cruciform shape. This shape transformation optimizes the number of wood lumbers that can be extracted from a given wood log. In a further step, wood lumbers are cut out of each of the cruciform shaped wood logs, and finally, the surfaces of the wood lumbers are trimmed to reduce roughness and splinters, and to obtain a consistent thickness throughout the length of the lumber.

The trimming step is generally carried out using one of more planer heads. A planer head has the general configuration of a large rotating wheel provided with a plurality of knives extending outwardly from its circumference. When a lumber passes about a planer head in rotation, the knives take off an outside layer of the wood lumber (typically a ¼ or ½ inch layer) thereby trimming and smoothing its surface. An example of a planer head 10 of the prior art is shown in FIGS. 1 to 3. In this prior art configuration, the planer head 10 includes a generally cylindrical body 12 having a centrally disposed bore 14 coinciding with an axis of rotation $R_1$ of the planer head 10 (which is also its longitudinal axis). The body 12 is plain and typically made of machined steel. The body 12 includes a plurality of knife pockets 16 (best shown in FIG. 2) radially disposed and uniformly distributed on a crenelated curved face 18 defining the circumference of the body 12, as best shown in FIG. 2.

The knife pockets 16 each includes a first wall 15, and a second wall 17 spaced apart and opposing the first wall 15. The first wall 15 can be scalloped, while the second wall 17 is substantially flat. Each of the knife pockets 16 is configured to receive a corresponding knife 20 (only one knife 20 being drawn in the figures) and a knife holder 22 for holding the knife 20 into position during the operation of the planer head 10.

Each knife 20 includes a connection portion 24 receivable in a knife pocket 16 to connect to the body 12, and a cutting edge 26 extending from the connection portion 24 to trim the wood lumbers when the planer head 10 is rotated about the axis of rotation $R_1$.

Knife holders 22 are typically longitudinal slender members that collaborate with clamping assemblies 30 to retain the knives 20 onto the body 12, where each knife holder 22 is operated by a corresponding one of the clamping assemblies 30 (best shown in FIG. 3).

As it will be appreciated by those skilled in the art, this planer head configuration suffers many drawbacks. The clamping assemblies 30 are independent of each other, and each knife holders 22 is operated by its unique and corresponding clamping assemblies 30. As such, when knives 20 must be installed, replaced or repositioned, the operations have to be repeated for each and every one of the clamping assemblies 30, which tends to make the replacement of the knives 20 burdensome and costly. Further, because each of the knife 20 is adjusted independently, they may not protrude radially from the pocket 16 equally, which may cause ovalization of the planer head 10.

In other examples of prior art planer heads, the clamping assemblies may be disposed somewhere else on the planer head, but still require a plurality of knife holders and a corresponding plurality of clamping or securing mechanism, which makes the maintenance of such planer heads cumbersome.

Therefore, there is a need for a planer head that will overcome at least one of the above-identified drawbacks.

BRIEF SUMMARY

According to a broad aspect of an embodiment of the present invention, there is provided a planer head comprising a generally cylindrical body including a first circular end, a second circular end and a crenelated curved face extending therebetween. The cylindrical body further includes a longitudinal rotation axis extending between the first circular end and the second circular end, and at least two knife pockets defined on the crenelated curved face and uniformly spaced-apart from one another. Each knife pocket includes a first wall and second wall, each pair of adjacent knife pockets defining a radially projecting knife retaining member therebetween. The planer head also comprises at least two knife holders, each knife holder being received in a corresponding knife pocket and being movable radially therein between a lower position and an upper position, each knife holder having first and second walls, the first wall of each knife holder being adjacent to the first wall of the knife pocket. The planer head also comprises at least two knives, each knife having a connection portion received in a corresponding knife pocket between the second wall of the knife holder and the second wall of the knife pocket, and a cutting portion extending from the connection portion and projecting radially from the crenelated curved face of the cylindrical body. According to this broad aspect, the planer head further comprises a clamping assembly including first and second clamping members mounted to the first and second circular ends of the cylindrical body and movable along the longitudinal rotation axis between a distal position and a proximal position, as well as a securing means for mounting the first and second clamping members to the first and second circular ends of the body and urging the first and second clamping members toward one another in the proximal position. When the first and second clamping members are in the distal position, the at least two knife holders are in the lower position thereby permitting movement of the at least two knives in the corresponding knife pockets while when the first and second clamping members are in the proximal position, they urge the at least two knife holders in the upper position thereby securing the at least two knifes in the corresponding at least two knife pockets.

According to another broad aspect of an embodiment, there is provided a kit of a planer head assembly. In this broad aspect, the kit comprises a generally cylindrical body including a first circular end, a second circular end and a crenelated curved face extending therebetween. The cylindrical body further includes a longitudinal rotation axis extending between the first circular end and the second circular end, and at least two knife pockets defined on the crenelated curved face and uniformly spaced-apart from one another. Each knife pocket includes a first wall and second wall, each pair of adjacent knife pockets defining a radially projecting knife retaining member therebetween. The kit also comprises at least two knife holders, each knife holder being receivable in a corresponding knife pocket and being movable radially therein between a lower position and an upper position, each knife holder having first and second walls, the first wall of each knife holder being adjacent to the first wall of the knife pocket when the cutter head is assembled, and at least two knives. Each knife has a connection portion receivable in a corresponding knife pocket between the second wall of the knife holder and the second wall of the knife pocket, and a cutting portion extending from the connection portion and projecting radially from the crenelated curved face of the cylindrical body when the cutter head is assembled. The kit further comprises a clamping assembly including first and second clamping members mountable to the first and second circular ends of the cylindrical body and movable along the longitudinal rotation axis between a distal position and a proximal position, and a securing means for mounting the first and second clamping members to the first and second circular ends of the body and urging the first and second clamping members toward one another in the proximal position. When the first and second clamping members are in the distal position, the at least two knife holders are in the lower position thereby permitting movement of the at least two knives in the corresponding knife pockets while when the first and second clamping members are in the proximal position, they urge the at least two knife holders in the upper position, thereby securing the at least two knifes in the corresponding knife pockets.

In an additional feature, the cylindrical body further comprises a bore extending between the first end to the second end for mounting the body to a rotating shaft.

In yet an additional feature, each of the at least two knife pockets extends longitudinally between the first end and the second end of the cylindrical body.

In still an additional feature, the first and second walls of each of the at least two knife pockets converge toward one another to define a funnel shape. Preferably, the first and second walls of each of the at least two knife holders also converge toward one another, to define a generally tapering cross-section.

In a further feature, the planer head comprises between 20 and 40 knife pockets and a corresponding number of knives and knife holders, and preferably 36 knife pockets and a corresponding number of knives and knife holders.

In another feature, the cylindrical body further comprises a first annular recess on the first circular end and a second annular recess on the second circular end. The first and second clamping members respectively comprise first and second annular rings at least partially engaged in the corresponding first and second recesses, the first and second annular rings engaging the at least two knife holders and urging the same in the upper position. Preferably, each of the first and second rings comprises an outer annular face, an inner annular face, a curved inner face and a beveled, curved outer face extending between the outer and inner annular faces. The beveled curved outer faces of the first and second annular rings engage the at least two knife holders and urge the same in the upper position. Still preferably, each of the at least two knife holders comprises first and second beveled faces, the first and second beveled faces of the at least two knife holders collaborating with the beveled curved outer faces of the first and second annular rings for urging the at least two knife holders in the upper position.

In an additional feature, the cylindrical body comprises a plurality of bores extending between the first and second circular ends and the first and second annular rings comprise a corresponding plurality of holes extending between the outer and inner annular faces thereof. In this additional feature, the fastening means of the clamping assembly comprises a corresponding plurality of bolts and nuts, each bolt being received in a corresponding bore of the cylindrical body and in corresponding holes in the first and second rings, the plurality of bolts and nuts urging the first and second rings to engage at least partially the first and second recesses the first and second rings to engage the at least two knife holders and urging the same in the upper position.

In still another feature, each of the first and second annular recesses of the cylindrical body comprises a threaded inner curved face. In this feature, the fastening means includes first and second annular fasteners and each annular fastener comprising an inner threaded curved face engaging the threaded inner curved faces of the cylindrical body and an inner annular face engaging the outer annular face of a corresponding ring. The fastening of the first and second annular fasteners engages the first and second rings at least partially in the corresponding recesses to engage the at least two knife holders and urging the same in the upper position.

In a further feature, first and second clamping members each comprises a plurality of segments, the plurality of segments defining together an annular ring.

According to yet another broad aspect of an embodiment, there is provided a clamping assembly for a planer head including a generally cylindrical body having at least two knife pockets, at least two knife holders and at least two knives receivable in the at least two knife pockets. In this broad aspect, the clamping assembly comprises first and second clamping members mountable to first and second circular ends of the cylindrical body and movable along a longitudinal rotation axis between a distal position and a proximal position, and a securing means for mounting the first and second clamping members to the first and second circular ends of the body and urging the first and second clamping members toward one another in the proximal position. When the first and second clamping members are in the distal position, the at least two knife holders are in a lower position in the knife pockets thereby permitting movement of the at least two knives in the knife pockets while when the first and second clamping members are in the proximal position, they urge the at least two knife holders in an upper position thereby securing the at least two knifes in the corresponding at least two knife pockets.

According to another broad aspect of an embodiment, there is provided a cylindrical body for a planer head. The cylindrical body comprises a first circular end, a second circular end and a crenelated curved face extending the first circular end and the second circular end. The cylindrical body also comprises a longitudinal rotation axis extending between the first circular end and the second circular end, and at least two knife pockets defined on the crenelated curved face and uniformly spaced-apart from one another. Each knife pocket includes a first wall and second wall, each pair of adjacent knife pockets defining a radially projecting knife retaining member therebetween. Each of the at least two knife pockets is configured to receive a knife holder and allowing movement of same in a radial direction between a lower position and an upper position, each knife holder having first and second walls, the first wall of each knife holder being adjacent to the first wall of the knife pocket and a connection portion of a knife. In this broad aspect, the cylindrical body is configured to receive a clamping assembly including first and second clamping members mountable to the first and circular second ends of the cylindrical body and movable along the longitudinal rotation axis between a distal position and a proximal position, and a securing means for mounting the first and second clamping members to the first and second circular ends of the cylindrical body and urging the first and second clamping members toward one another in the proximal position. When the first and second clamping members are in the distal position, the at least two knife holders are in the lower position thereby permitting movement of the at least two knives in the corresponding knife pockets while when the first and second clamping members are in the proximal position, they urge the at least two knife holders in the upper position thereby securing the at least two knifes in the corresponding at least two knife pockets.

Embodiments of the present can have at least one of the above-mentioned aspects, but do not necessarily have all of them.

Additional and/or alternative features, aspects, and advantages of embodiments of the present will become apparent from the following description, the accompanying drawings, and the appended claims.

BRIEF DESCRIPTION OF THE DRAWINGS

For a better understanding of the present, as well as other aspects, and further features thereof, reference is made to the following description which is to be used in conjunction with the accompanying drawings, where.

DETAILED DESCRIPTION

Figure 6:
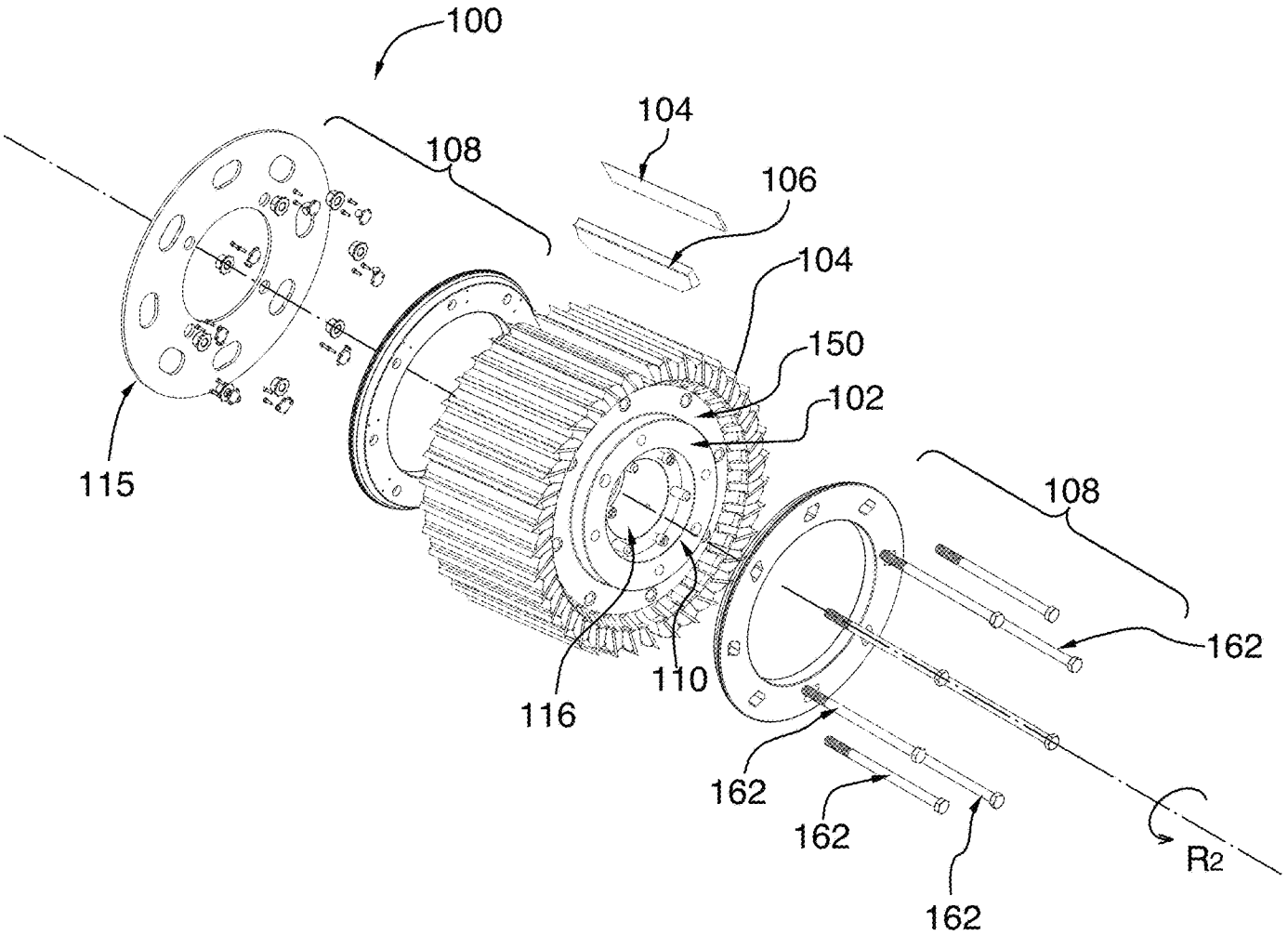
FIG. 6 is a right perspective, partially exploded view of the planer head shown in FIG. 4.
Figure 7:
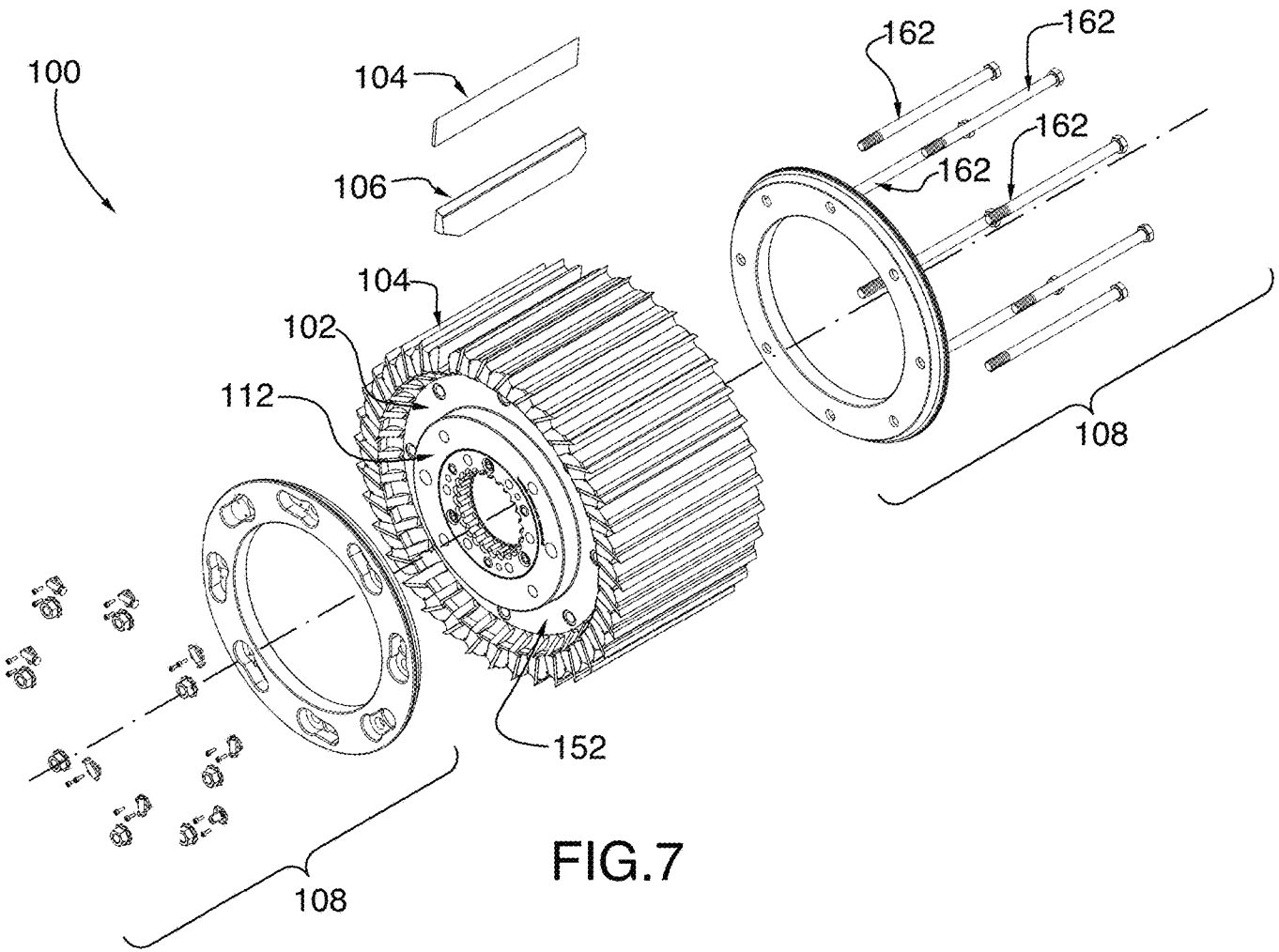
FIG. 7 is a left perspective, partially exploded view of the planer head shown in FIG. 4.

Referring to FIGS. 4 to 21, a first embodiment of a planer head 100 will be described. In this embodiment, the planer head 100 includes a body 102, a plurality of knives 104, a corresponding plurality of knife holders 106 and a clamping assembly 108 (best shown in FIGS. 6 and 14), which collaborate with the knife holders 106 for securing knives 104 to the body 102 (only some knives 104 and knife holders 106 being identified with reference numerals). In the illustrated embodiment, the planer head 100 includes 36 knives 104 and 36 knife holders 106. It is however contemplated that the planer head 100 could comprise a different number of knives 104 and corresponding knife holders 106. For instance, the planer head 100 could comprise two or more knives 104 and knife holders 106. In one embodiment, the planer head 100 could comprise between 10 and 60 knives 104 and knife holders 106, and preferably between 20 and 40 knives 104 and knife holders 106.

Figure 8:
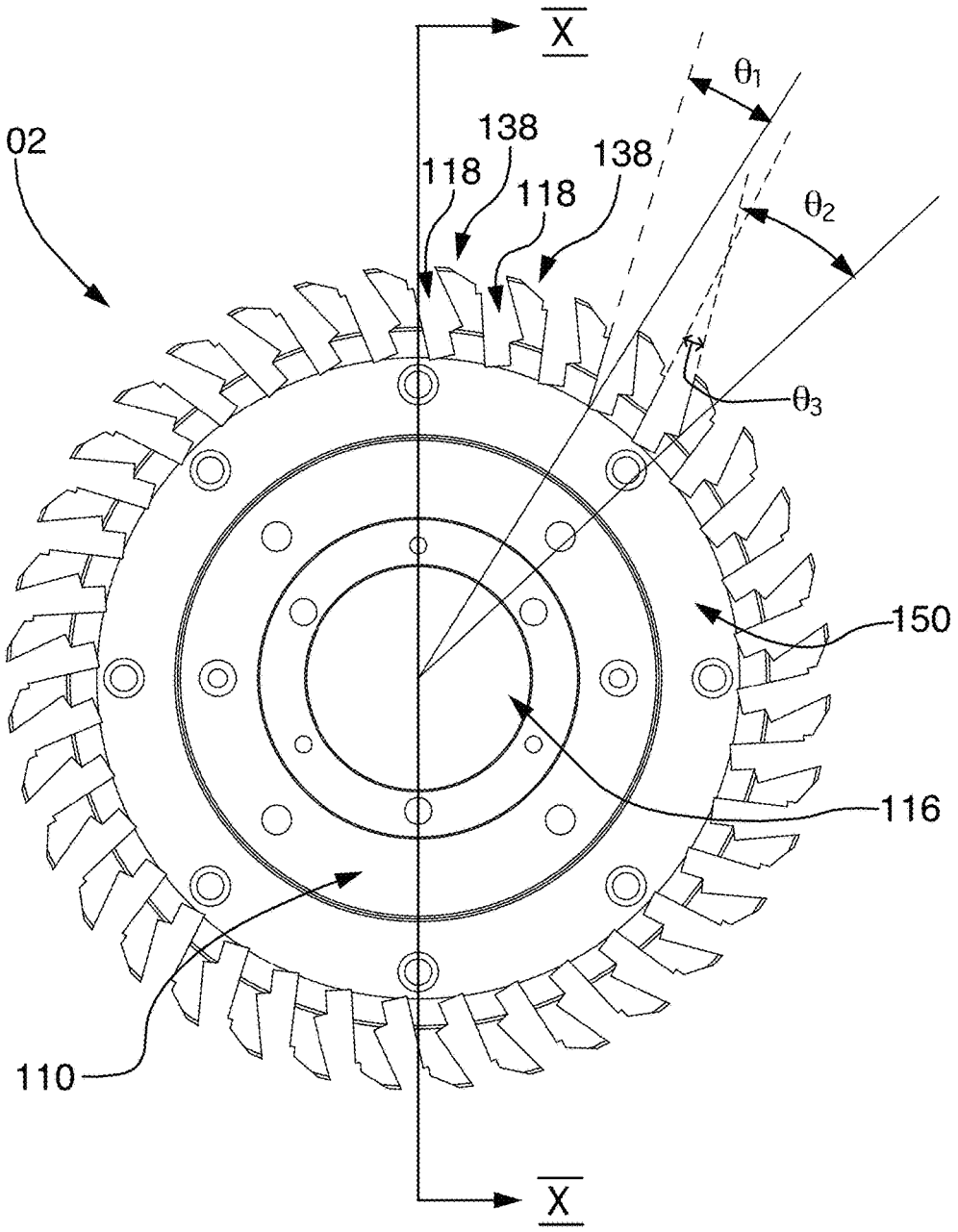
FIG. 8 is a right view of the cylindrical body of the planer head shown in FIG. 4.
Figure 9:
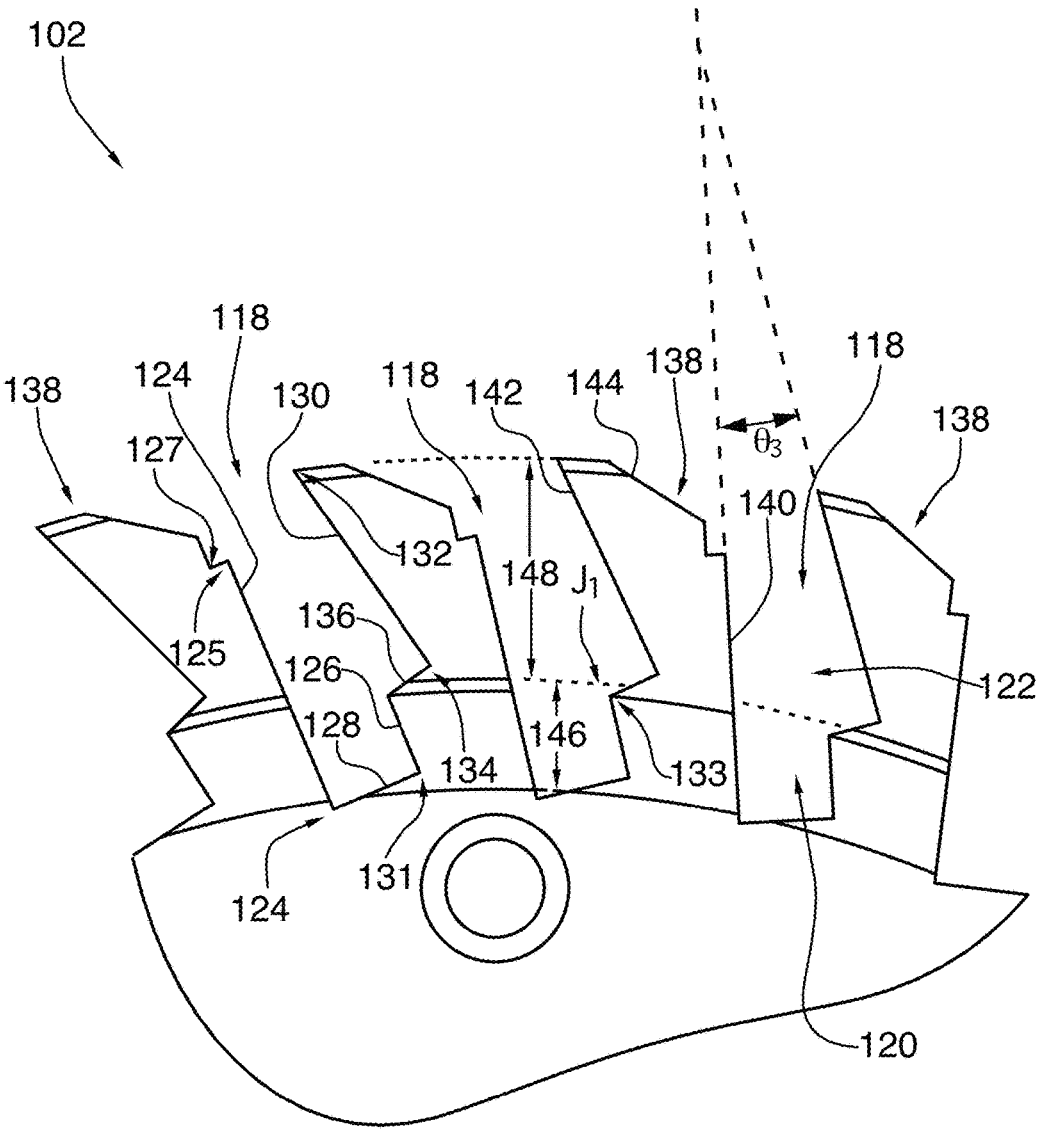
FIG. 9 is an enlarged, right view of cylindrical body shown in FIG. 8, showing knife pockets and knife retaining members.
Figure 10:
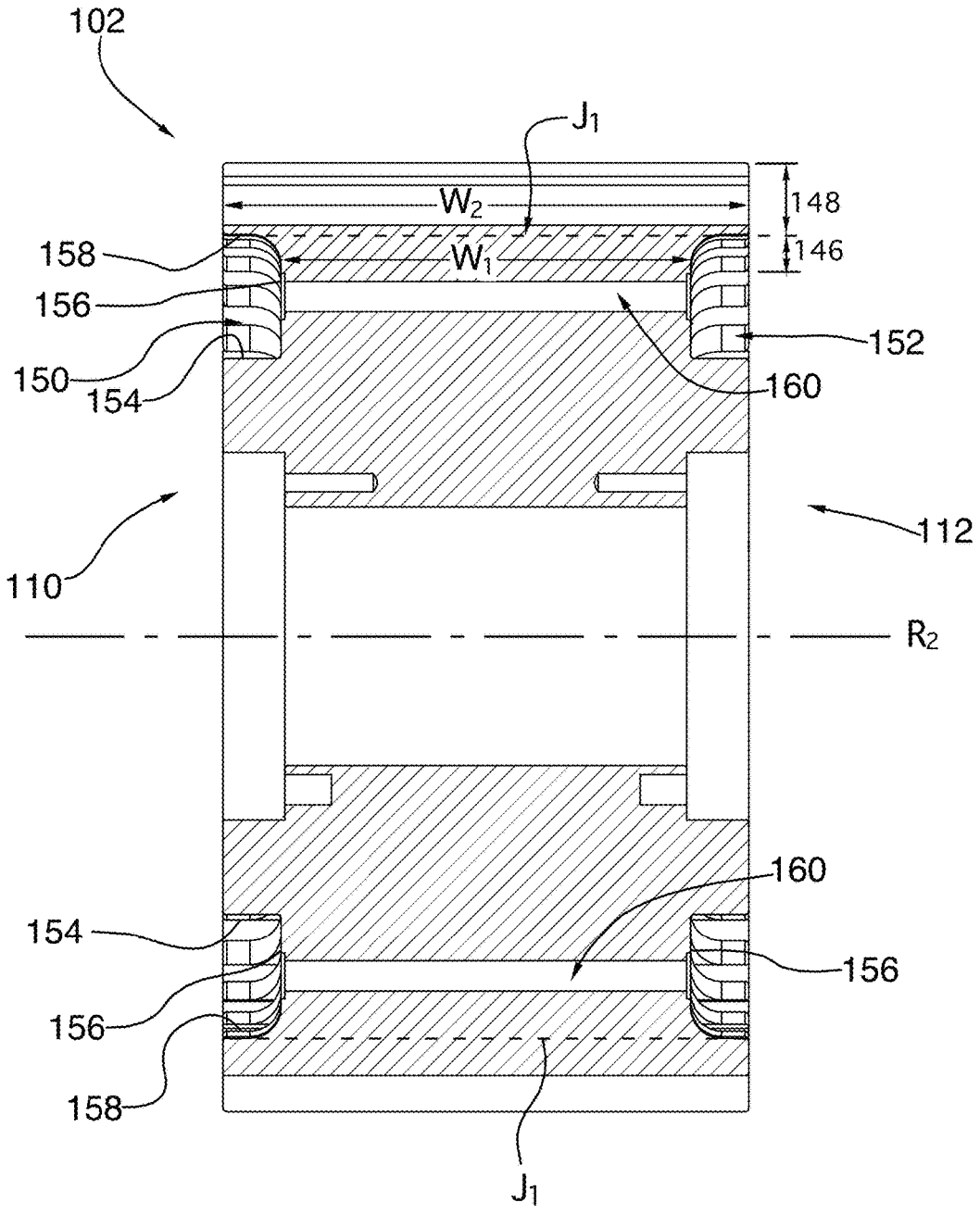
FIG. 10 is a cross-section view of the cylindrical body shown in FIG. 8, taken along line X-X.

With reference to FIGS. 8 to 10, the body 102 is generally cylindrical and has a generally circular right end 110, a generally circular left end 112 and a crenelated curved face 114 extending between the right end 110 and the left end 112 and defining the circumference of the body 102. The body 102 is preferably made of machined steel. The body 102 has a centrally disposed bore 116 extending between the right end 110 and the left end 112 for mounting the planer head 100 on a rotating shaft (not shown), for rotation about an axis of rotation $R_2$.

The body 102 includes a plurality of knife pockets 118 disposed on the curved face 114 (best shown in FIG. 9). In the embodiment shown, the body includes 36 knife pockets 118. The person skilled in the art will appreciate that the number of knife pockets 118 could be different, and that the number of such knife pockets 118 will define the number of knives 104 and knife holders 106 mountable to the body 102. The knife pockets 118 are uniformly spaced apart (i.e. distributed) along the crenelated curved face 114 or circumference of the body 102.

Each knife pocket 118 is sized and shaped to receive a corresponding knife 104 and a corresponding knife holder 106 therein. Each knife pocket comprises a lower receiving portion 120 and an upper receiving portion 122 (best shown in FIG. 9). The lower and upper receiving portions 120, 122 share a common front wall 124, which is forwardly angled at an angle $\theta_1$ relative to a radius extending from the rotation axis $R_2$ to the bottom end 129 of the front wall 124 (see FIG. 8). At the top end 125 of the front wall 124 is defined a recess 127 for retaining a knife holder 106 received in the knife pocket 118, as it will be described in greater detail below. The lower receiving portion 120 is also provided with a back wall 126, spaced apart from the front wall 124 and extending parallel thereto, as well as a bottom wall 128 extending between the front wall 124 and the back wall 126 and perpendicular thereto, at the bottom ends 129, 131 thereof.

The upper receiving portion 122 of the knife pocket 118 comprises a back wall 130 having a top end 132 and a bottom end 134. The back wall 130 is forwardly angled at an angle $\theta_2$ relative to a radius extending from the rotation axis $R_2$ to the bottom end 134. As one can appreciate from FIG. 8, the angle $\theta_2$ is larger than the angle $\theta_1$, and therefore the top end 132 of the back wall 130 converges toward the front wall 124, at an angle $\theta_3$, to define somewhat of a funneled shaped knife pocket 118 (see FIG. 9). While in the illustrated embodiment, the front and back walls 124, 126 and 130 are generally flat, it is contemplated that in an alternative embodiment at least one of them could be scalloped to increase frictional engagement with the knife 104 and knife holder 106.

Extending between the bottom end 134 of the back wall 130 and the bottom end 131 of the back wall 126 of the lower receiving portion 120 is an knife resting wall 136. The knife resting wall 136 extends perpendicular to the back wall 130 and provides support to the knife 104 received in the knife pocket 118, as it will become apparent below.

As it will be appreciated, a portion of the body 102 extends generally radially between each pair of adjacent knife pockets 118. Together, the knife pockets 118 therefore define a plurality of knife retaining members 138, each retaining member 138 comprising a trailing face 140 (corresponding to the front wall 124 of a first knife pocket 118), a leading face 142 (corresponding to the back walls 126 and 130 of the adjacent knife pocket 118) and a forwardly and upwardly angled top face 144 extending between the trailing face 140 and the leading face 142. Each knife retaining member 138 also includes lower portion 146 extending from the bottom wall 128 of the lower portion 120 to a junction $J_1$ corresponding to the junction between the upper end 133 of the back wall 126 and the knife resting wall 136, as well as an upper portion 148 extending from the junction $J_1$ to the top face 144 of the retaining member 138.

Returning to FIGS. 6 and 7, a right annular recess 150 is defined on the right end 110 of the body 102 for receiving a portion of the clamping assembly 108. Likewise, the left end 112 of the body 102 is provided with a left annular recess 152 for receiving another portion of the clamping assembly 108, as it will be described in greater detail below. As best shown in FIG. 10, the right annular recess 150 comprises a lower curved face 154 extending longitudinally (i.e. parallel to the rotation axis $R_2$) and an annular right face 156 extending radially and perpendicularly to the lower curved face 154. The right annular recess 150 also comprises an upper curved face 158 defined on the lower portion 146 of the knife retaining members 138, the upper curved face 158 extending from the annular right face 156 to the junction $J_1$. As best shown in FIG. 10, the upper curved face 158 is gently curved outwardly to smoothly transition from the radial orientation of the angular right face 156 (i.e. perpendicular to the rotation axis $R_2$) to a longitudinal orientation (i.e. parallel to the rotation axis $R_2$). The left annular recess 152 is merely a mirror image of the right annular recess 150. As such, the description of the right annular recess 150 applies to the left annular recess 152, with proper adaptation. As it will be apparent from FIG. 10, the right and left annular recesses 150, 152 cause the knife retaining members 138 to define somewhat of a T-shape, where the lower portion 146 of the knife retaining member 138 has a width $W_1$ and the upper portion 148 has a wider width $W_2$.

Defined in the right and left annular recesses 150, 152 and extending longitudinally between the right and left ends 110, 112 is a plurality of bores 160 for receiving a corresponding plurality of fasteners 162 used to secure the clamping assembly 108, as it will become apparent below.

Figure 11A:
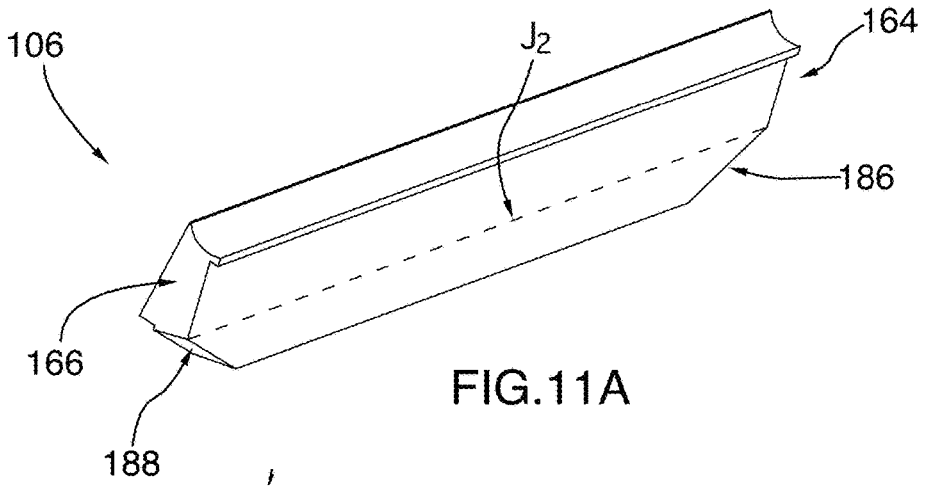
FIG. 11A is a front left perspective view of a knife holder of the planer head shown in FIG. 4.
Figure 11B:
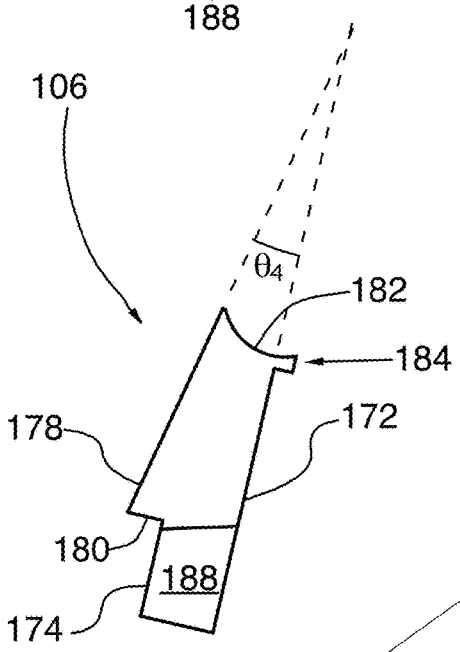
FIG. 11B is a side view of the knife holder shown in FIG. 11A.
Figure 11C:
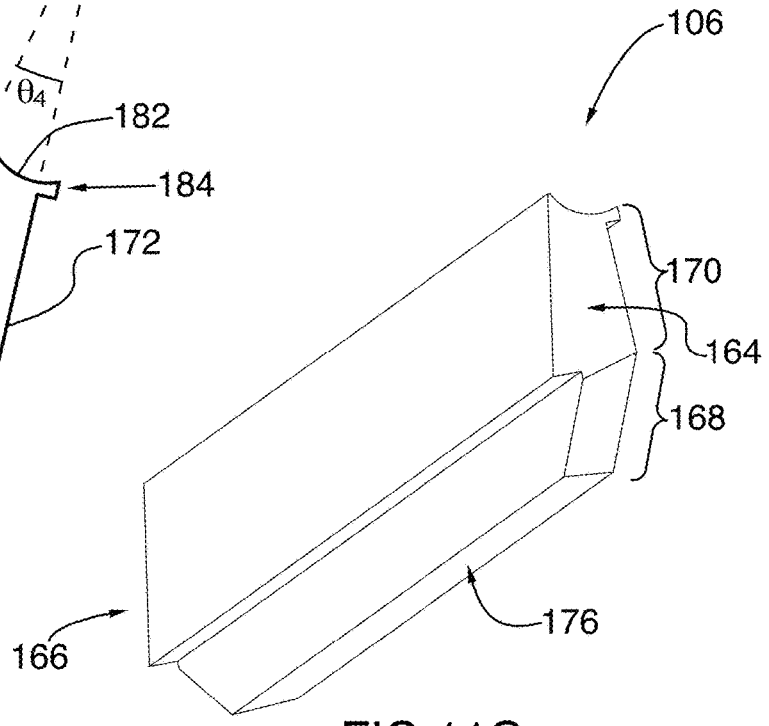
FIG. 11C is a back left perspective view of the knife holder shown in FIG. 11A.

Turning now to FIGS. 11A to 11C, the knife holders 106 will be described in accordance with one embodiment. In this embodiment, each knife holder 106 has a longitudinal oriented slender body having a right end 164 and a left end 166. The knife holder 106 further comprises a lower portion 168 sized and shaped to be received in the lower receiving portion 120 of a knife pocket 118, and an upper portion 170, sized and shaped to be received in the upper receiving portion 122 of the corresponding knife pocket 118. The lower and upper portions 168, 170 of the knife holder 106 share a common leading face 172 configured to abut the front wall 124 of the knife pocket 118. The lower portion 168 of the knife pocket also comprises a trailing face 174, parallel to the leading face 172, and a bottom face 176 extending between the leading face 172 and the trailing face 174, perpendicular thereto. The upper portion 170 also comprises a trailing face 178, extending at an angle $\theta_4$ relative to the leading face 172. Extending between the lower end of the trailing face 178 of the upper portion 170 and the trailing face 174 of the lower portion 168 is an intermediate face 180. Extending between the trailing face 178 of the upper portion 170, and the leading face 172, at the upper end thereof, is a curved top face 182 terminating in a forwardly extending lip 184, sized and shaped to be received in the recess 127 of the knife pocket 118.

Figure 12:
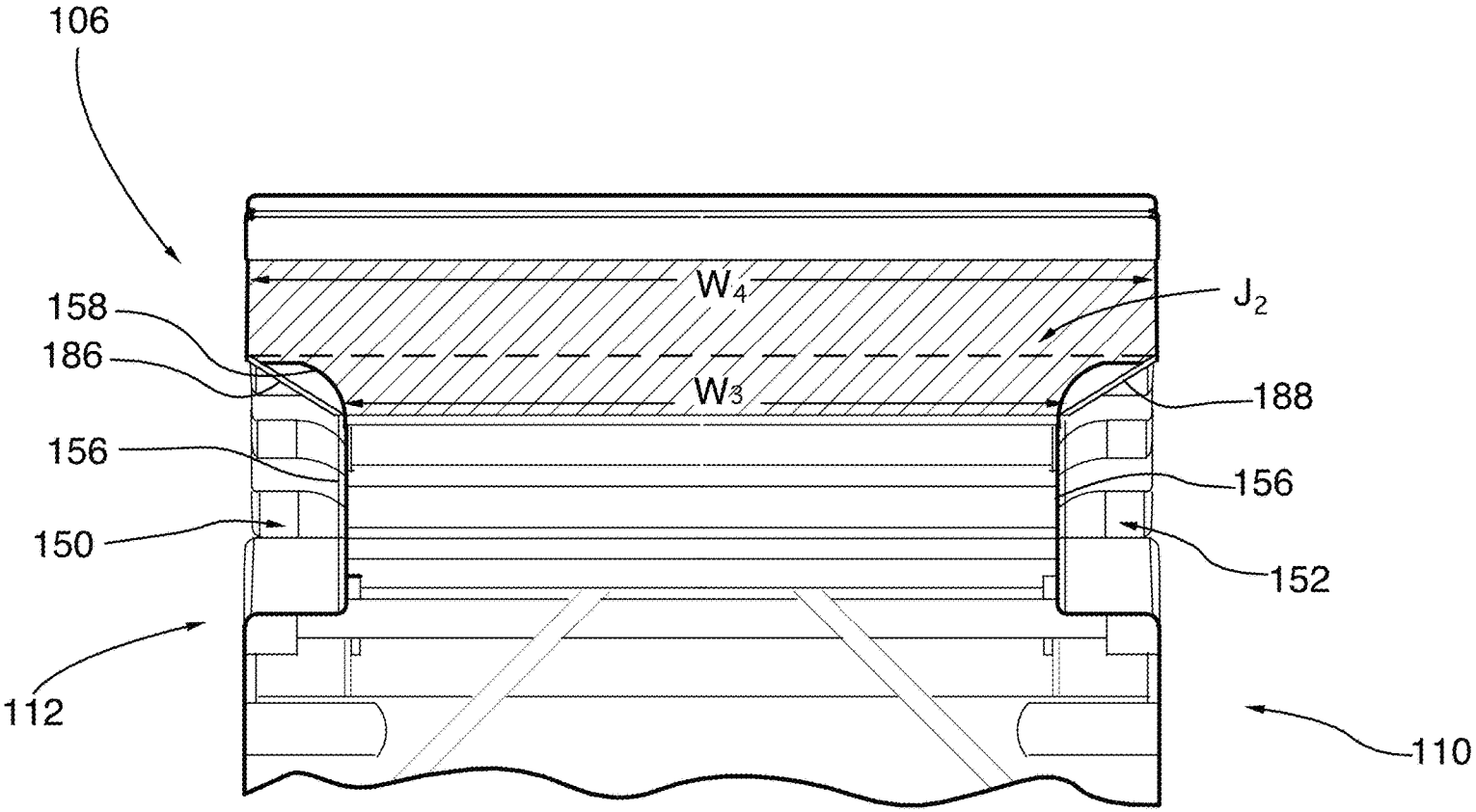
FIG. 12 is a cross-section view of the cylindrical body shown in FIG. 8, taken along line X-X, with a knife holder in a knife pocket.

The lower portion 168 and the upper portion 170 of the knife holder 106 meet at a junction $J_2$ (shown in FIG. 11A). As best shown in FIG. 12, the bottom face 176 has a width $W_3$ corresponding to width $W_1$ of the knife retaining member 138, at the upper portion 148 thereof, while the upper portion 170 of the knife holder 106 has a width $W_4$ corresponding to the width $W_2$ of the knife retaining member 138, at the upper portion 148 thereof. As such, beveled right and left faces 186, 188 extend from the bottom face 176 to the junction $J_2$.

As it can be seen in FIG. 12, the beveled right and left faces 186, 188 extend or project into the recesses 150 and 152 absent the clamping assembly 108. As it will become apparent below, these beveled right and left faces 186, 188 collaborate with the clamping assembly 108 to force the knife holder 106 in a radially outward position, thereby securing the knife 104 in the knife pocket 118 by frictional engagement. In one embodiment, each knife holder 106 is made of machined iron tool steel. The skilled addressee will appreciate that various alternative embodiments may be provided.

Figure 13A:
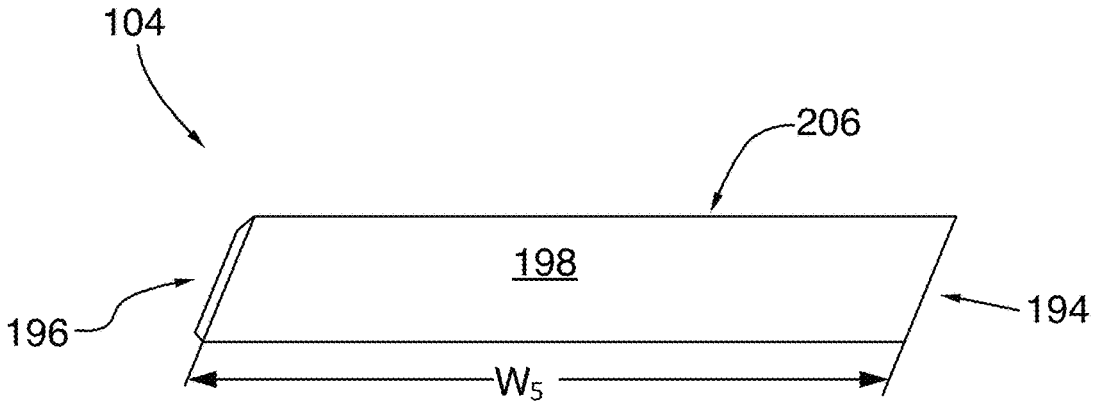
FIG. 13A is a front left perspective view of a knife of the planer head shown in FIG. 4.
Figure 13B:
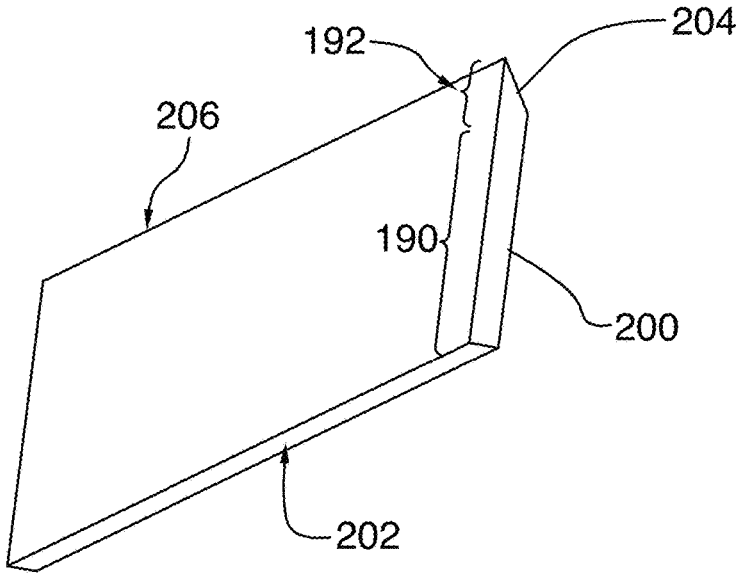
FIG. 13B is a front right perspective view of the knife shown in FIG. 13A.

With reference to FIGS. 13A and 13B, each knife 104 has the general shape of a rectangular plate and comprises a connection portion 190 receivable in a corresponding knife pocket 118 and a cutting portion 192 extending therefrom. Each knife 104 has a right end 194, a left end 196, as well as a leading face 198 and a parallel trailing face 200 extending therebetween. Extending perpendicularly to the leading and trailing faces 198, 200, at the lower end thereof, is a bottom face 202, while a top face 204 extends angularly (upwardly and forwardly) from the upper end of the trailing face 200 toward the upper end of the leading face 198 to define a cutting edge 206. The knife 104 has a width $W_5$ corresponding to the width $W_2$ of the knife retaining member 138. In one embodiment, each knife 104 is made of machined iron tool steel. The skilled addressee will appreciated that various alternative embodiments may be provided.

When the knife 104 is positioned in the knife pocket 118 (best shown in FIGS. 21A and 21B), the connection portion 190 is received in the knife pocket 118, and the cutting edge 206 extends outwardly from the body 102. The cutting edges 206 of the knives 104 are disposed so that they face a same forward direction to effectively cut an outside layer of the wood lumbers (not shown) when the planer head 100 is rotated about the axis $R_2$.

Figure 1:
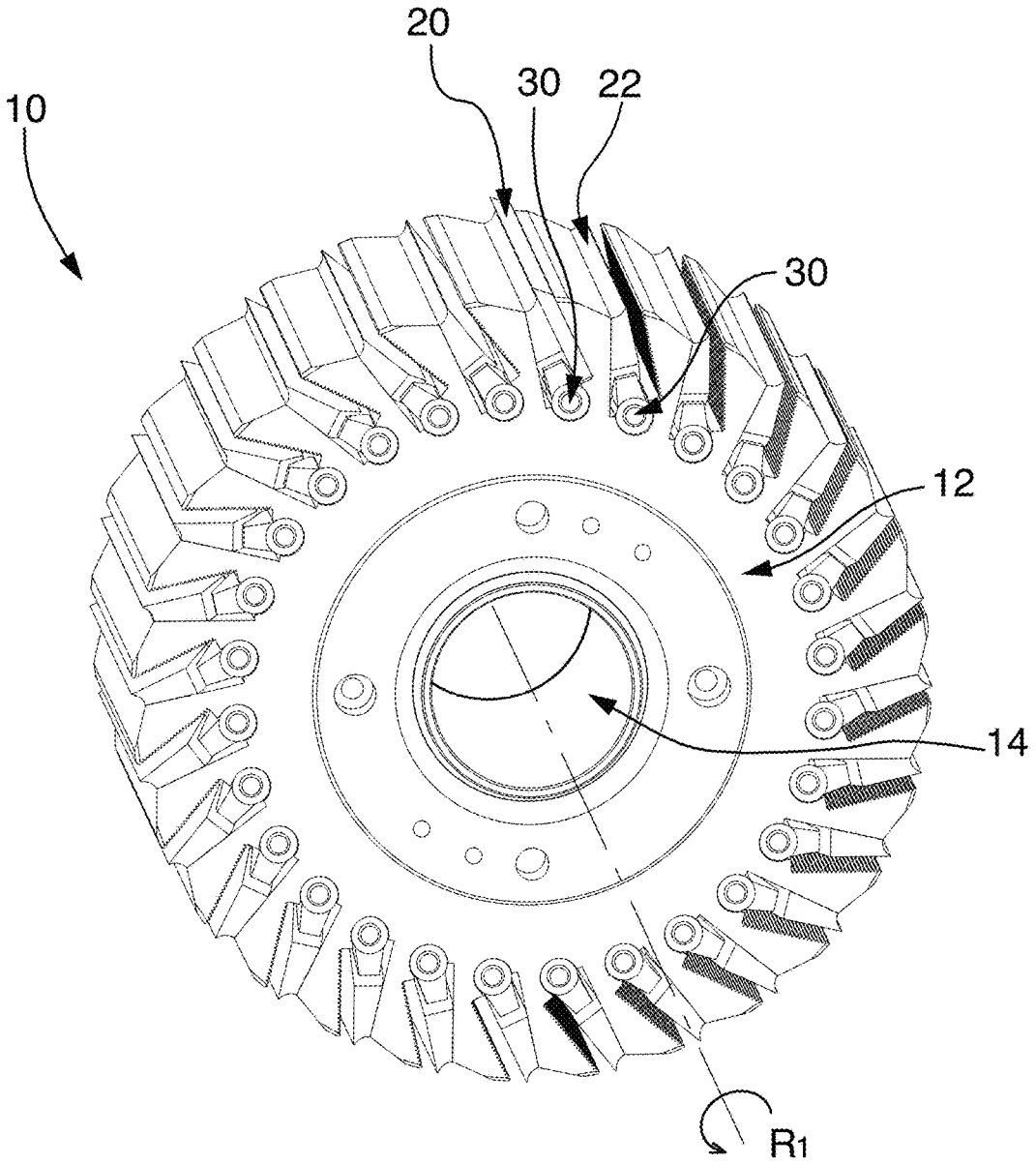
FIG.1 (Prior Art)
FIG. 1 is a perspective view of a planer head of the prior art shown with only one knife.
Figure 2:
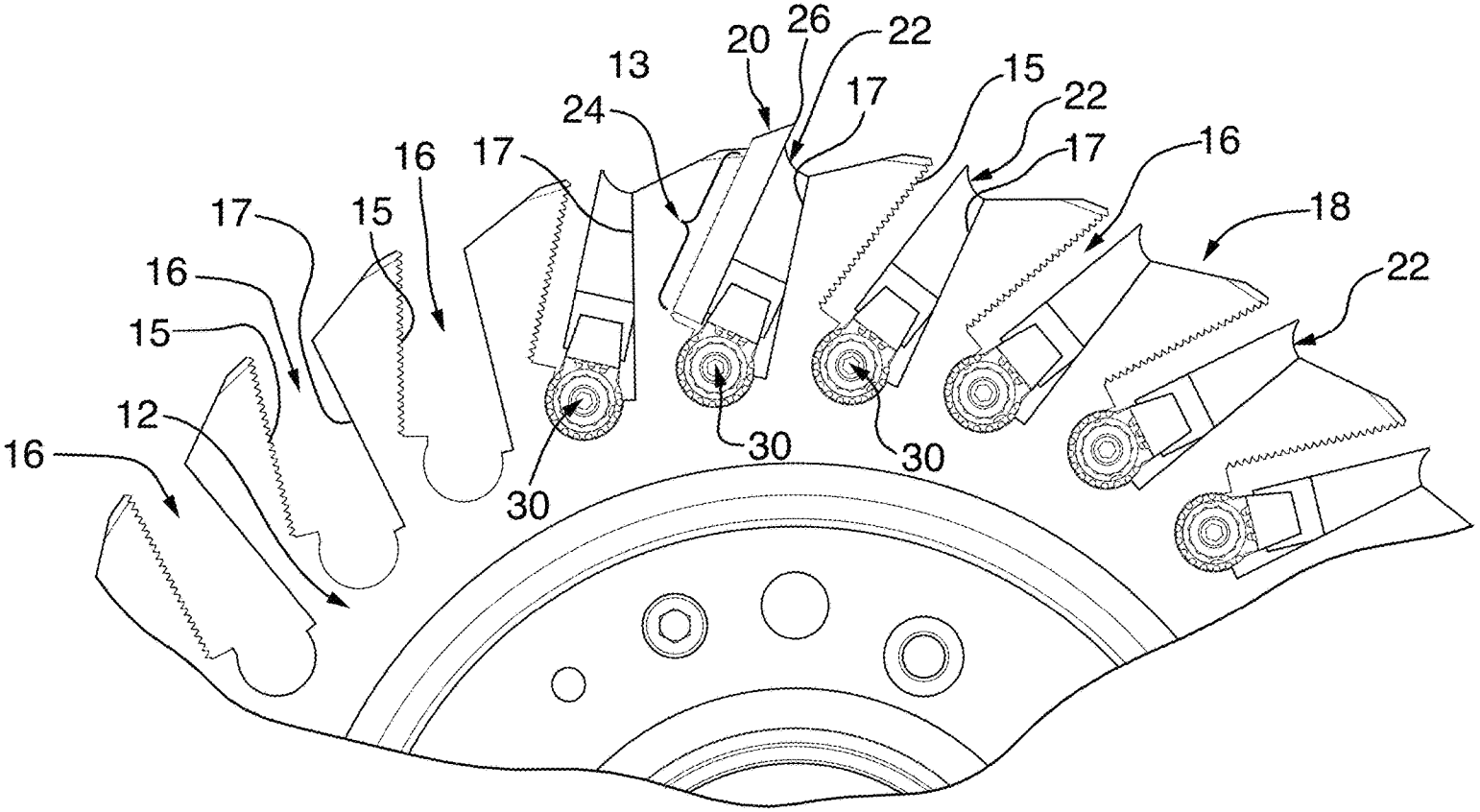
FIG.2 (Prior Art)
FIG. 2 is a close up, left side view of the prior art planer head of FIG. 1.
Figure 3:
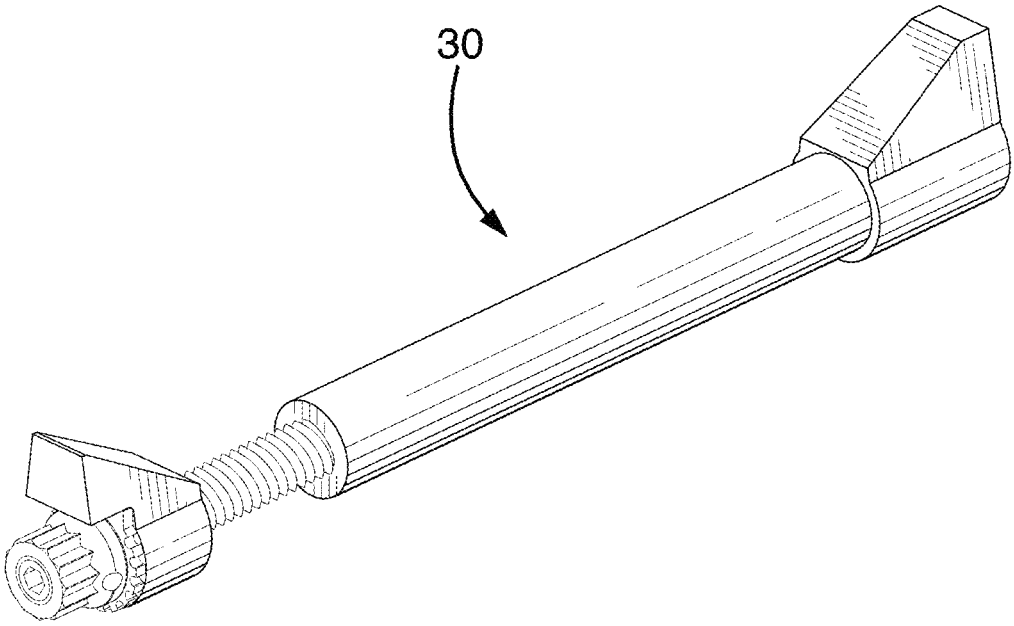
FIG.3 (Prior Art)
FIG. 3 is a perspective view of a clamping assembly for the prior art planer head shown in FIG. 1.
Figure 4:
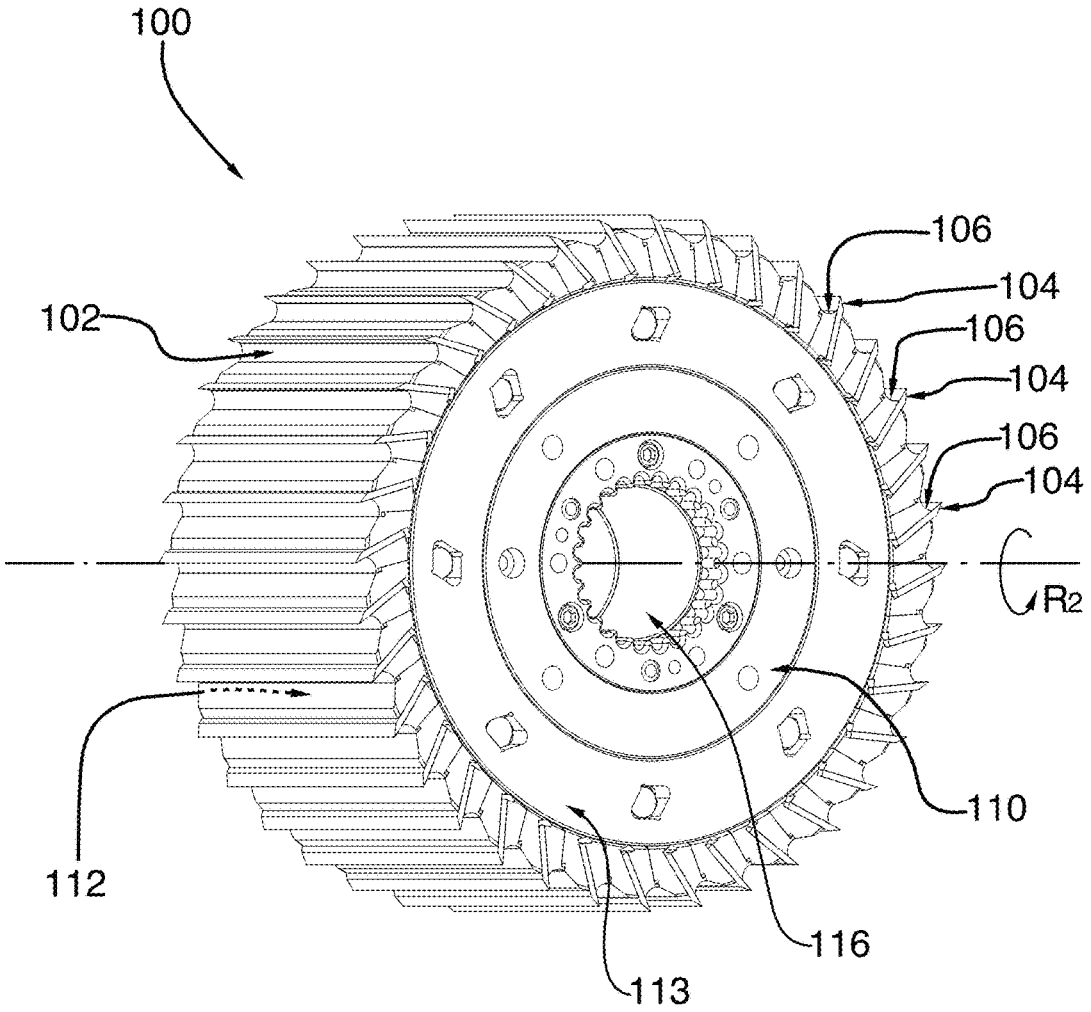
FIG. 4 is a right perspective view of a planer head according to a first embodiment.
Figure 5:
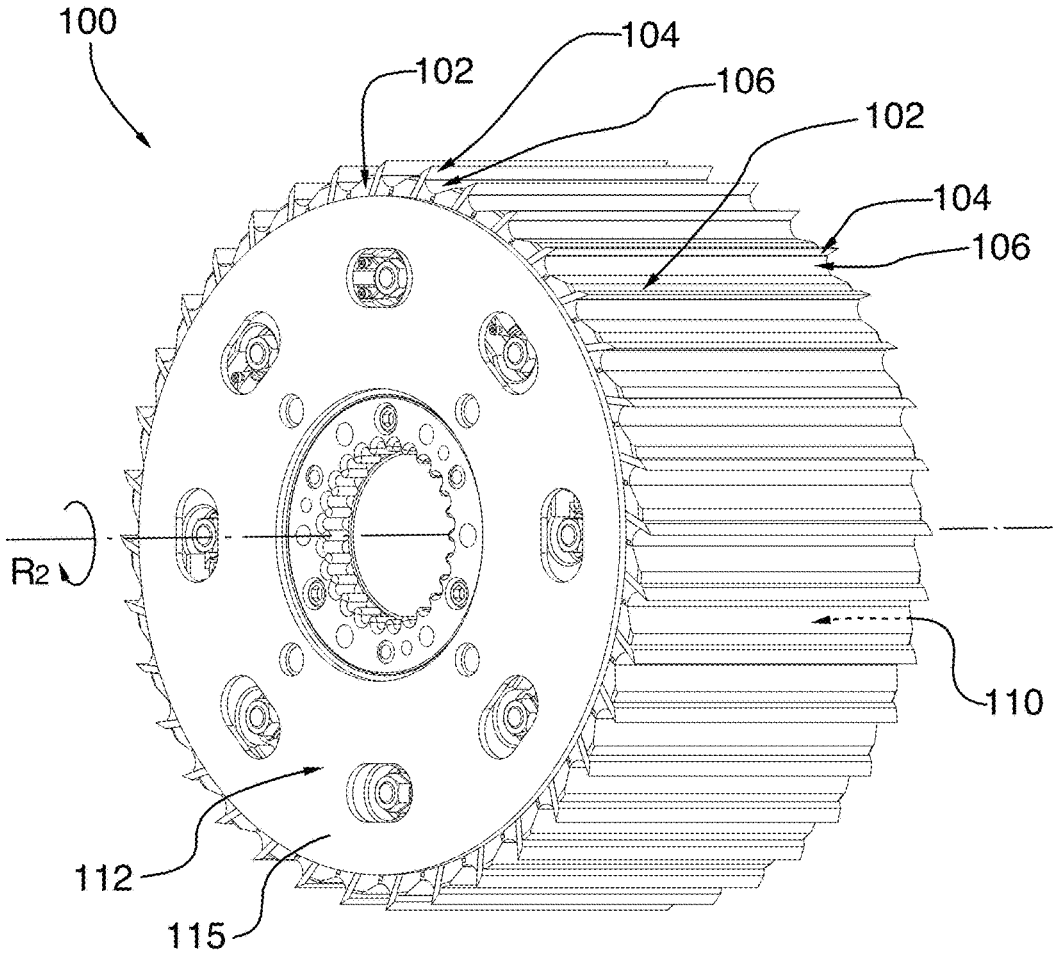
FIG. 5 is a left perspective view of the planer head shown in FIG. 4.

Contrary to the systems of the prior art, for which an example has been described above with respect to FIGS. 1 to 3, the planer head 100 includes a single clamping assembly 108 to simultaneously secure all the knives 104 to the body 102, via the knife holders 106. In the embodiment shown in FIGS. 4 to 21, the clamping assembly 108 comprises a right clamping sub-assembly including a right ring 208 sized and shaped to be received in the right annular recess 150 of the body 102, a left clamping sub-assembly including a left ring 210 sized and shaped to be received in the left annular recess 152 of the body 102 and the plurality of fasteners 162 receivable in the bores 160 for securing the right and left rings 208, 210 to the body 102 and securing the knives 104 to the body 102, via the knife holders 106.

Figure 14:
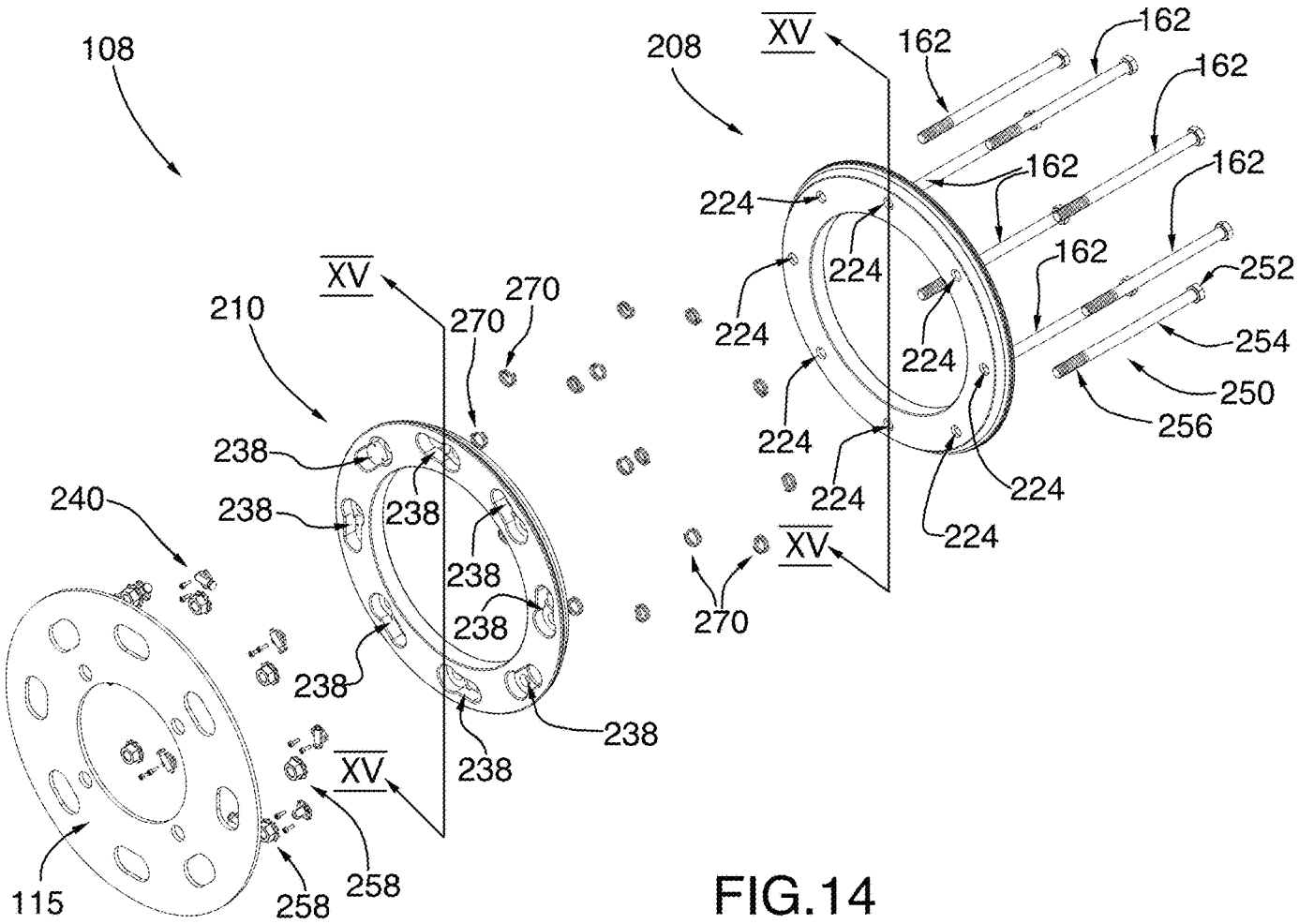
FIG. 14 is a left perspective, exploded view of the clamping assembly of the planer head shown in FIG. 4.
Figure 15:
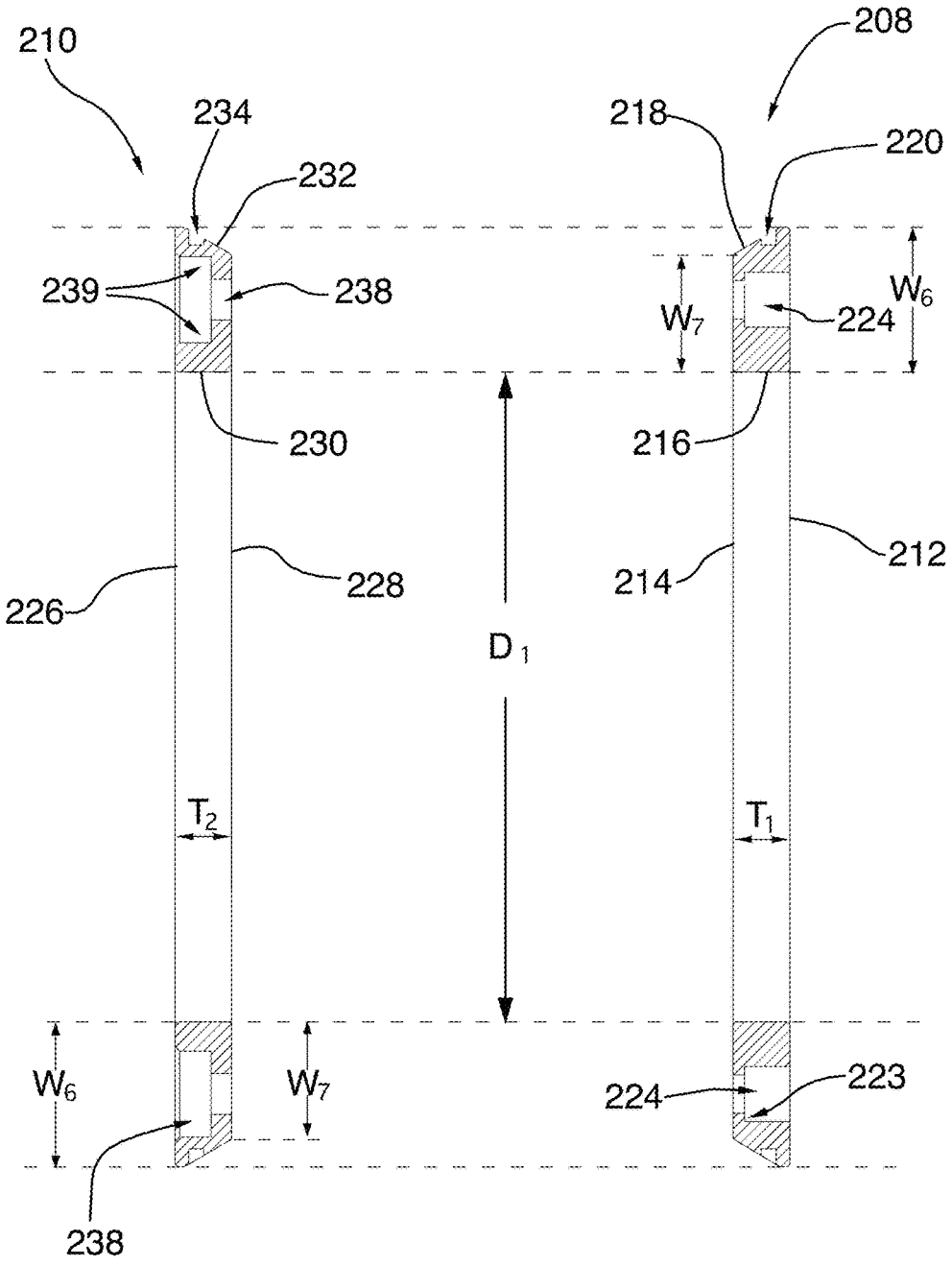
FIG. 15 is a longitudinal cross-section view of the right and left annular rings of the clamping assembly shown in FIG. 14, taken along lines XV-XV.

As best shown in FIGS. 14 and 15, the right ring 208 comprises an outer annular face 212 having a width $W_6$, an inner annular face 214 having a narrower width $W_7$ and a first curved face 216 defining an inner diameter $D_1$ of the ring 208 and extending perpendicular to the outer and inner annular faces 212, 214 (i.e. longitudinally or parallel to the rotation axis $R_2$). The right ring 208 also comprises a second, beveled face 218 extending between the outer and inner annular faces 212, 214. Defined on the second, beveled face 218 is a recess 220, in which is received a ring or dampener 222 (best shown in FIGS. 16 and 20B) to improve sealing and reduce vibrations when the right ring 208 is installed and the planer head 100 is operated. In one embodiment, the dampener 222 is made of a rubber material, for instance a nitrile synthetic rubber. In the illustrated embodiment, the right ring 208 has a thickness $T_1$, defined between the outer annular face 212 and the inner annular face 214, which is slightly less than a depth $d_1$ of the right annular recess 150 (shown in FIG. 16). Defined in the right ring 208 is a plurality of flanged holes 224. The flanged holes 224 are distributed on the right ring 208 to be in alignment with the bores 160 of the body 102 when the right ring 208 is properly positioned in the right recess 150. Further, the flanged holes 224 are sized and shaped to allow the passage of a portion of the fasteners 162 while providing an abutment area or flange 223 for another portion of the fasteners 162. In the illustrated embodiment, the flanged holes 224 are generally circular, but other hole shapes are contemplated.

Likewise, the left ring 210 comprises an outer annular face 226 having a width $W_6$, an inner annular face 228 having a narrower width $W_7$ and a first curved face 230 defining an inner diameter $D_1$ of the ring 210 and extending perpendicular to the outer and inner annular faces 226, 228 (i.e. longitudinal or parallel to the rotation axis $R_2$). The right ring 210 also comprises a second, beveled face 232 extending between the outer and inner annular faces 226, 228. Defined on the second, beveled face 232 is a recess 234, in which is received a ring or dampener 236 similar to dampener 222. In the illustrated embodiment, the right ring 210 has a thickness $T_2$, defined between the outer annular face 226 and the inner annular face 228, which is slightly less than a depth $d_2$ of the left annular recess 152 (shown in FIG. 16). It will be understood the thicknesses $T_1$ and $T_2$ of the rings 208 and 210 could be larger than the depths $d_1$ and $d_2$ of the right and left annular recesses 150, 152 and yet, allow achieving the purpose of the embodiment. In this case, the rings 208, 210 would engage the recesses 150, 152 only partially rather than completely, as illustrated in FIG. 16.

Defined in the right ring 210 is a plurality of flanged holes 238. The flanged holes 238 are distributed on the right ring 210 to be in alignment with the bores 160 of the body 102 and the holes 224 of the right ring 208 when right and left rings 210 are properly positioned in the right recesses 150 and 152, respectively. The flanged holes 238 are sized and shaped to allow the passage of a portion of the fasteners 162 while providing an abutment area or flange 239 for another portion of the fasteners 162, and to receive a locking assembly 240 for locking the fastener 162, as it will become apparent below. In the illustrated embodiment, the flanged holes 238 have a key shape, but it will be understood that other shapes of flanged holes 238 are contemplated.

Figure 16:
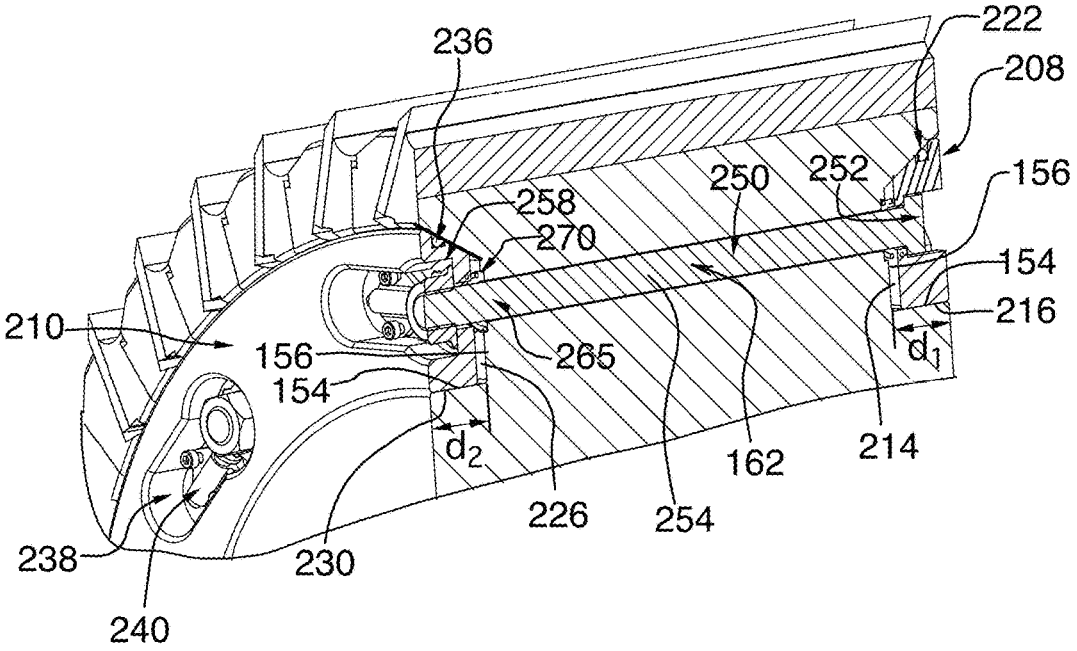
FIG. 16 is an enlarged, longitudinal cross-section view of the planer head shown in FIG. 4.

As it can be seen in FIG. 16, the first curved face 216 of the right ring 208 adjoins the lower curved face 154 of the right recess 150 when the ring 208 is in position in the right recess 150, while the inner annular face 214 of the right ring 208 extends along the annular right face 156, parallel thereto. Likewise, the first curved face 230 of the left ring 210 adjoins the lower curved face 154 of the left recess 152 when the ring 210 is in position in the left recess 152, while the inner annular face 226 of the left ring 210 extends along the annular left face 156, parallel thereto. In one embodiment, the right and left rings 208, 201 are made of steel. The skilled addressee will appreciate that various alternative embodiments may be possible.

The fasteners 162 are used to secure the right and left rings 208, 210 to the body 102. In the illustrated embodiment, each fastener 162 comprises a bolt 250 having a head 252 and an elongated portion 254 provided with a threaded portion 256, and a nut 258 engaging the threaded portion 256. Each bolt 250 is adapted to extend through a corresponding flanged hole 224 of the right ring 208, the head 252 resting against the flange 223 of the flanged hole 224, through a corresponding hole 160 in the body 102 and then through a corresponding flanged hole 238 in the left ring 210. The nut 258 is receivable in the key-shaped flanged hole 238 of the left ring 210 to engage the threaded portion 256 of the corresponding bolt 250. As it will be appreciated, the screwing of the nuts bolts 250 and nuts 258 forces the right and left rings 208, 210 toward one another, thereby causing the right and left rings 208, 210 to engage the right and left recesses 150, 152, respectively. Although in the illustrated embodiment, the planer head 100 comprises 8 fasteners 162, it will be understood that a different number of fasteners is contemplated. As it will be understood however, the number of fastener 162 to secure is greatly reduced as compared to the number of clamping assemblies of the prior art planer head configurations (e.g. the clamping assembly 30 shown in FIG. 3). The skilled addressee will appreciate that various alternative embodiments may be possible.

Figure 17:
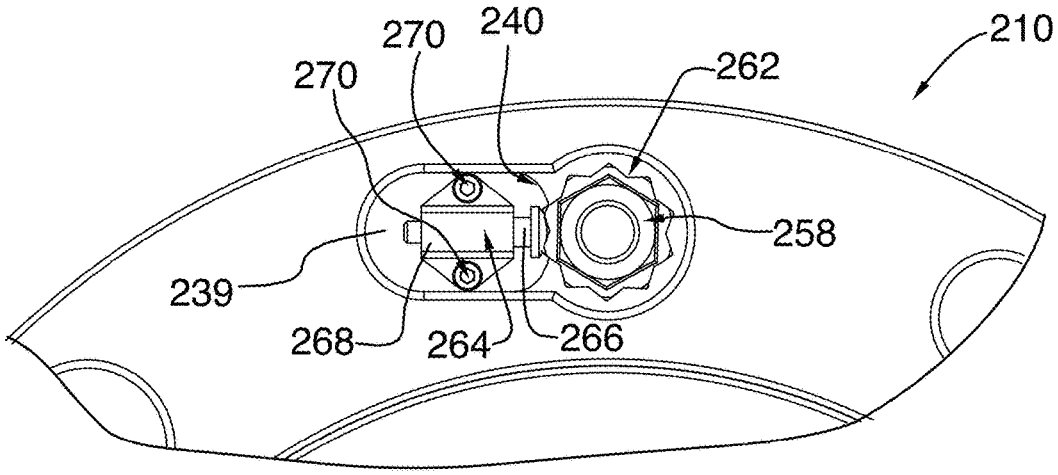
FIG. 17 is an enlarged, left side view of the planer head shown in FIG. 4, showing the locking assembly.
Figure 18:
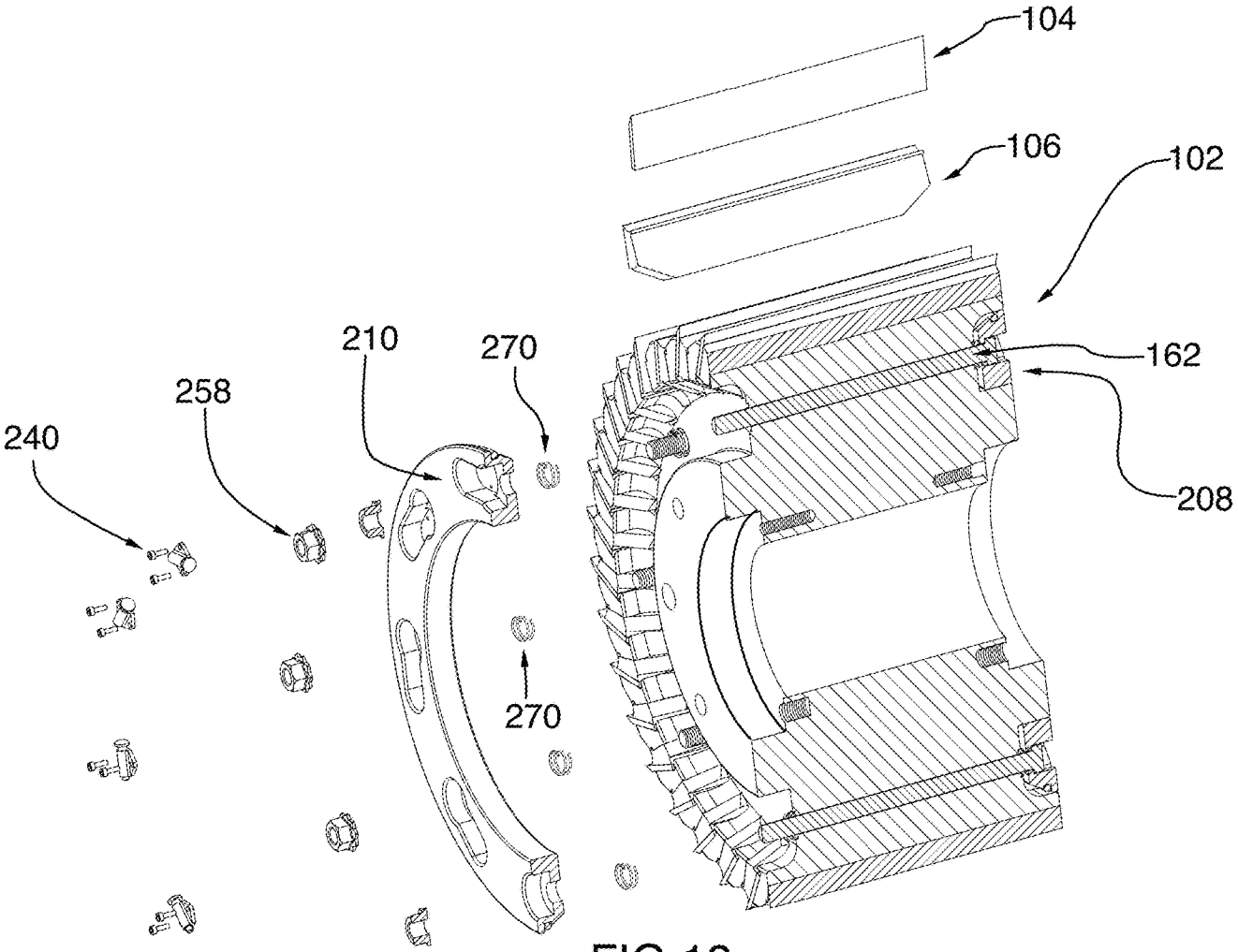
FIG. 18 is a left, partially exploded, longitudinal cross-section view of the planer head shown in FIG. 4.
Figure 19:
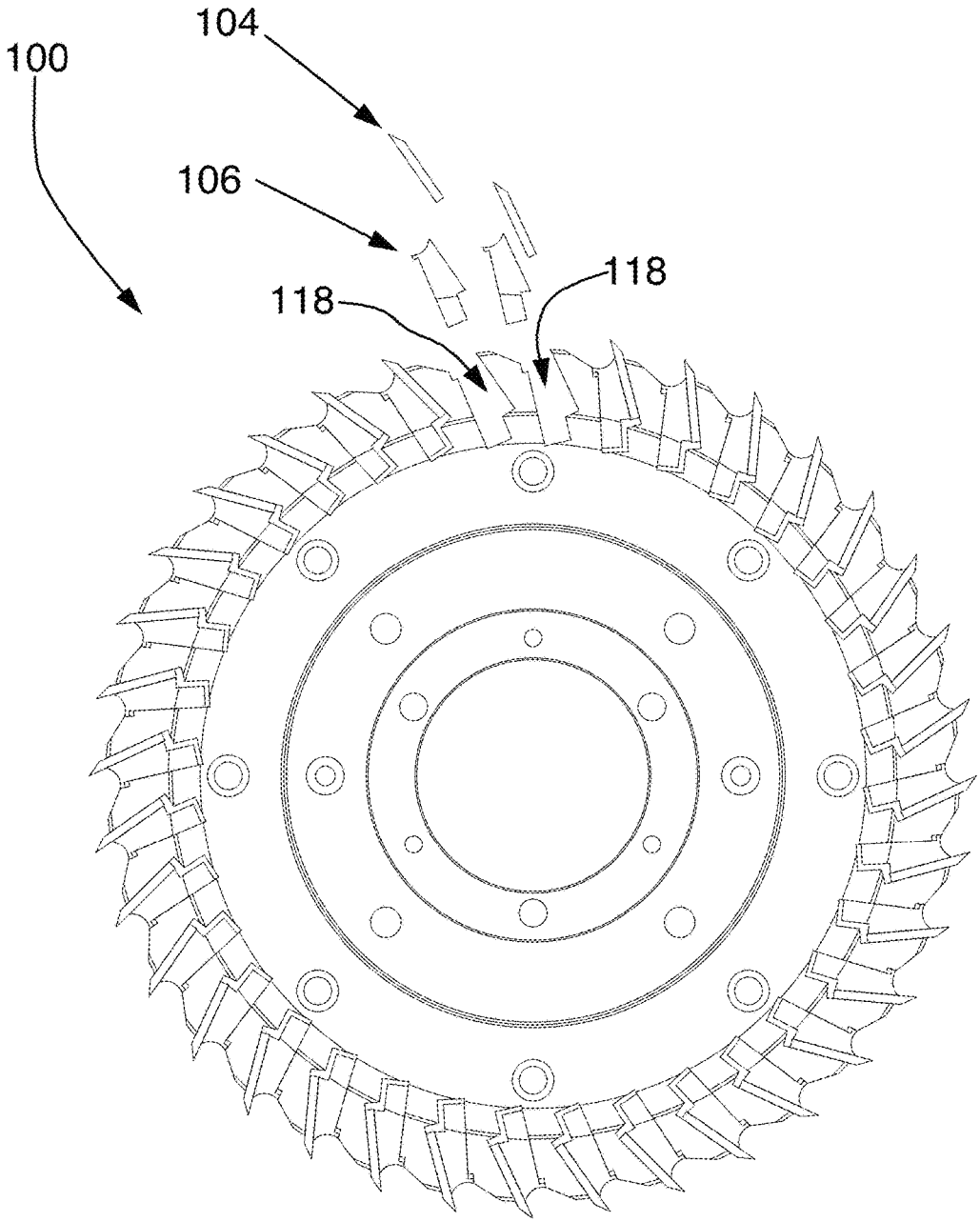
FIG. 19 is a right view of the cylindrical body, knife holders and knives of the planer head shown in FIG. 4, with two knife holders and two knives removed.
Figure 20A:
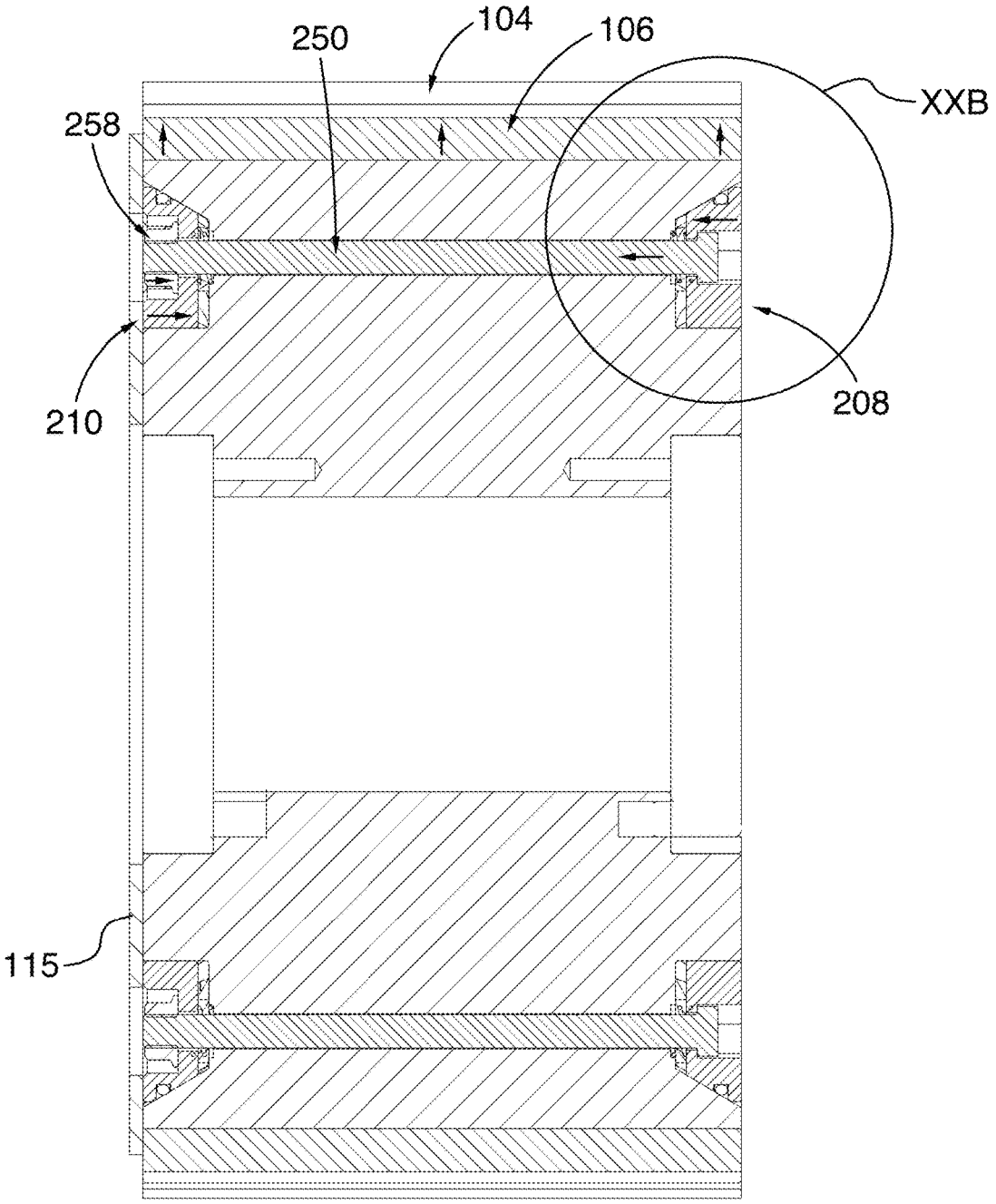
FIG. 20A is a longitudinal cross-section view of the planer head shown in FIG. 4, showing the movement of the fasteners, annular rings and knife holders.
Figure 20B:
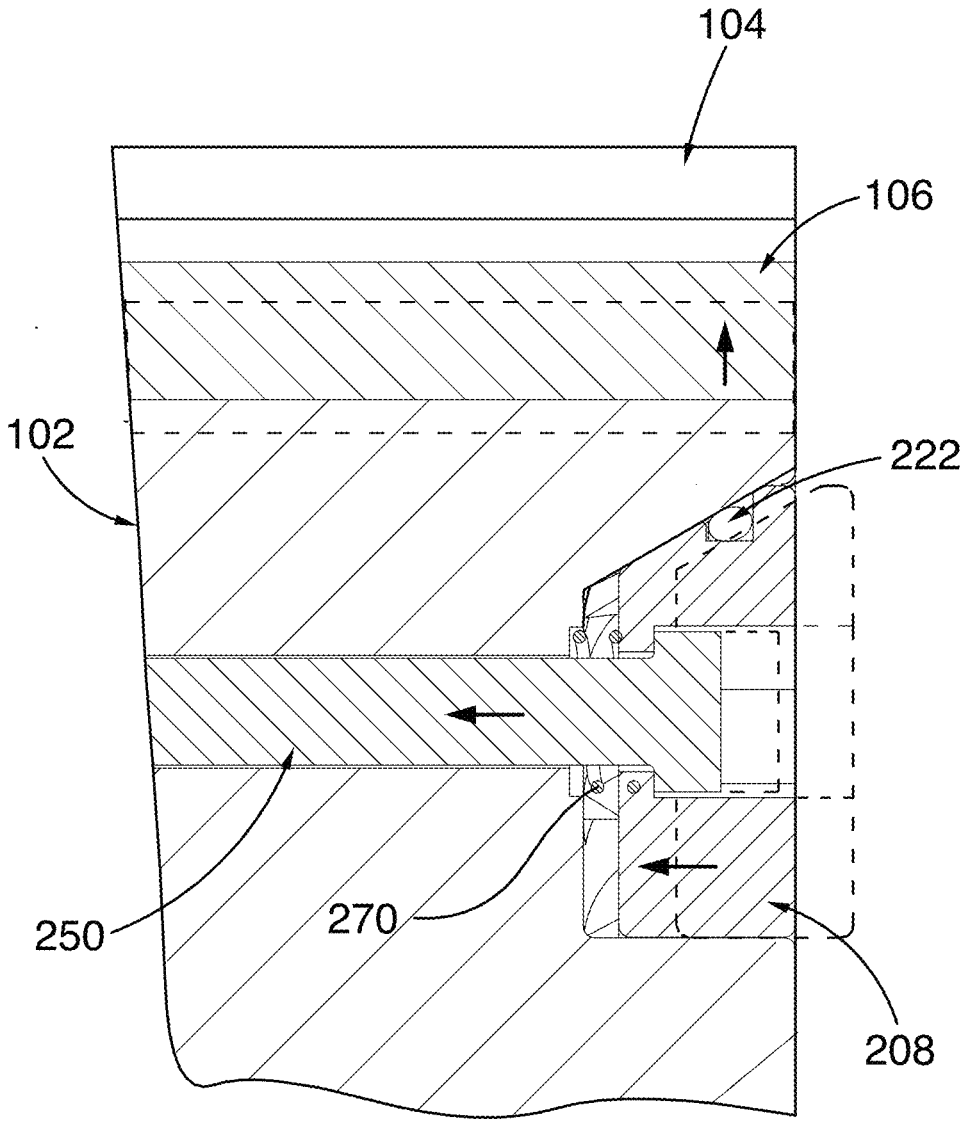
FIG. 20B is an enlarged view of a portion of a fastener, an annular ring and a knife holder shown in FIG. 20A.
Figure 21A:
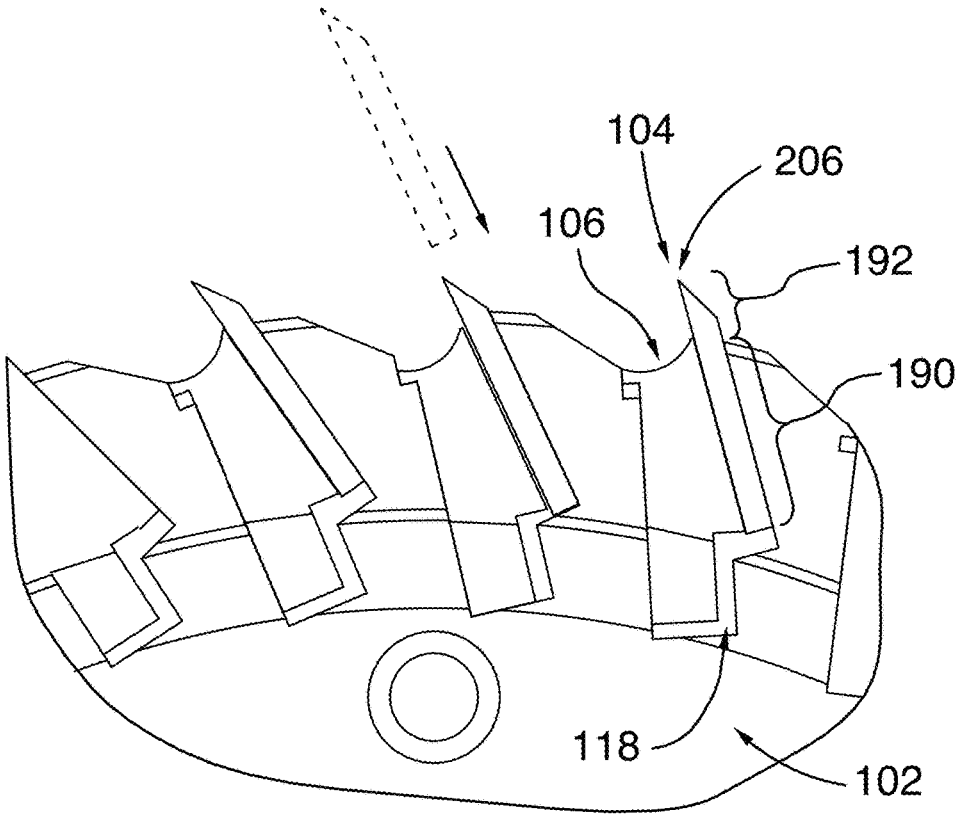
FIG. 21A is an enlarged right side view of a portion of the planer head shown in FIG. 4, showing the positioning of a knife in a knife pocket.
Figure 21B:
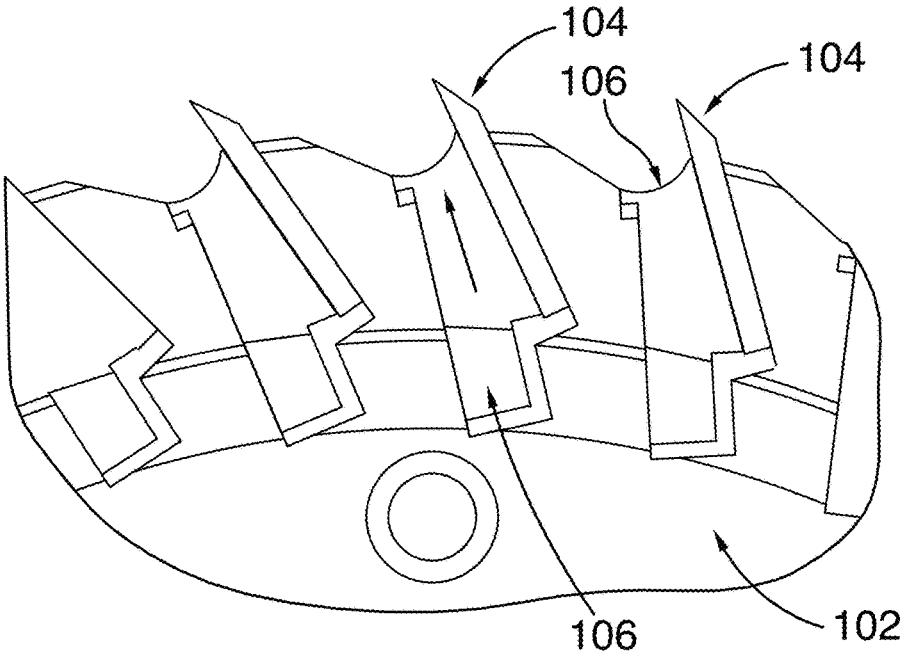
FIG. 21B is another enlarged side view of the portion of the planer head shown in FIG. 21, showing the movement of the knife holder to fasten the knife.
Figure 22:
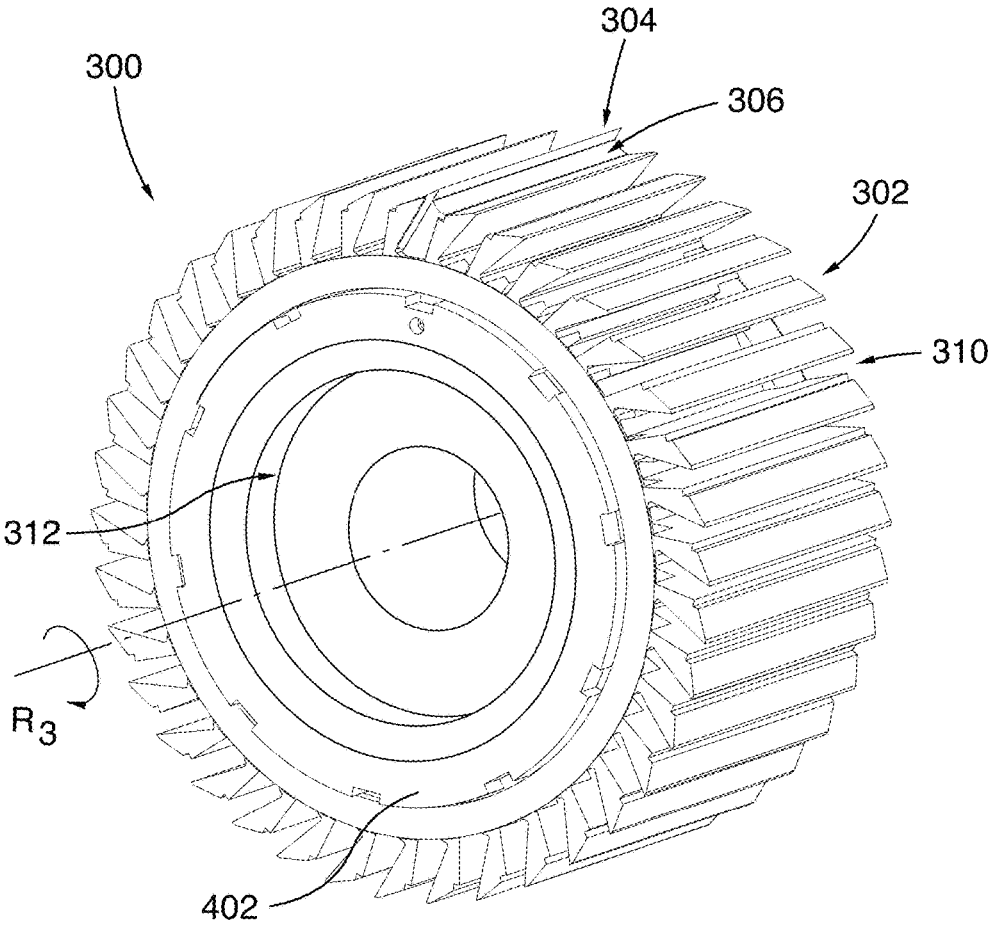
FIG. 22 is a left side view of a planer head according to another embodiment, with only one knife holder and one knife installed.
Figure 23:
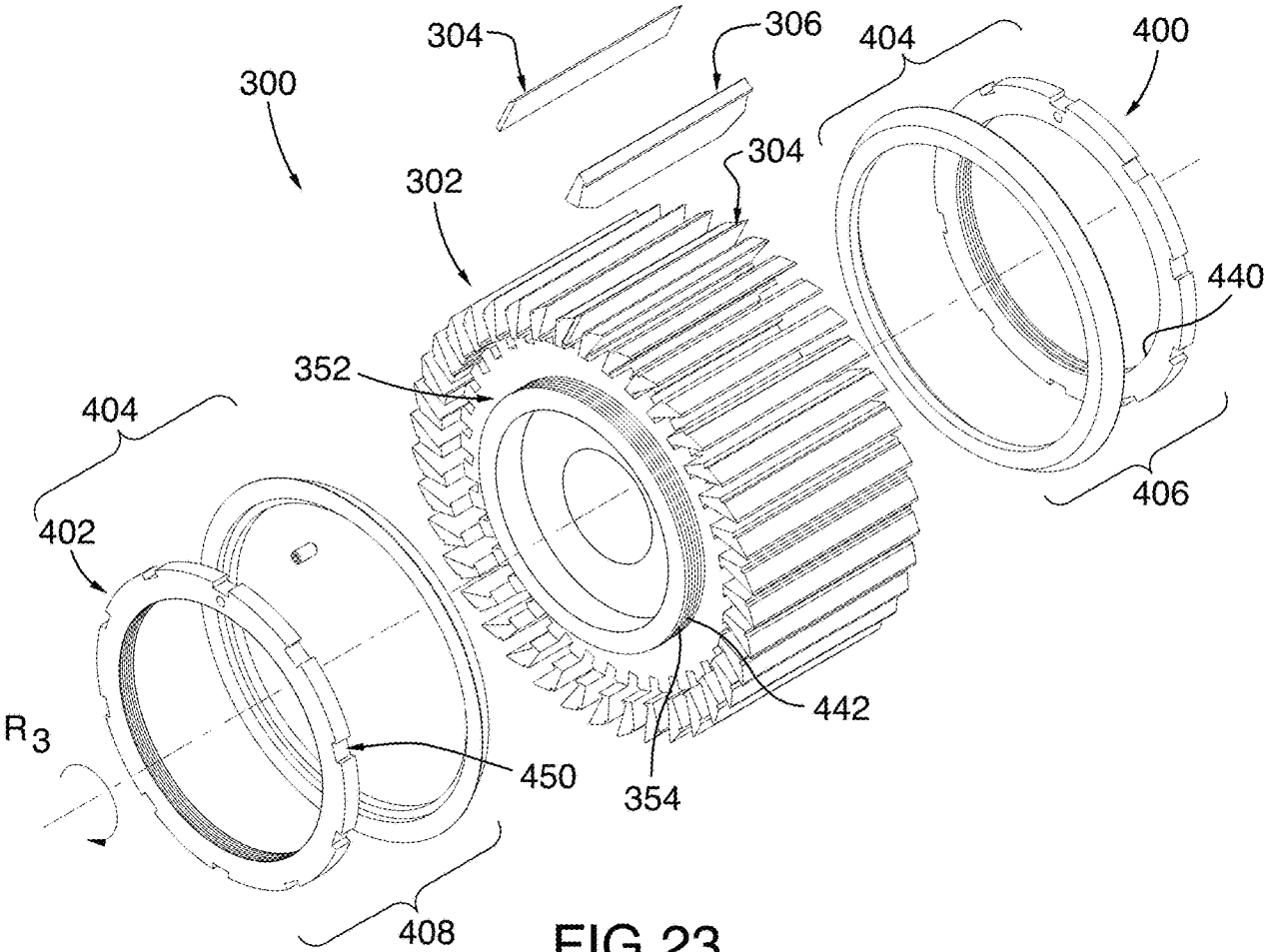
FIG. 23 is an exploded view of the planer head shown in FIG. 22.
Figure 24:
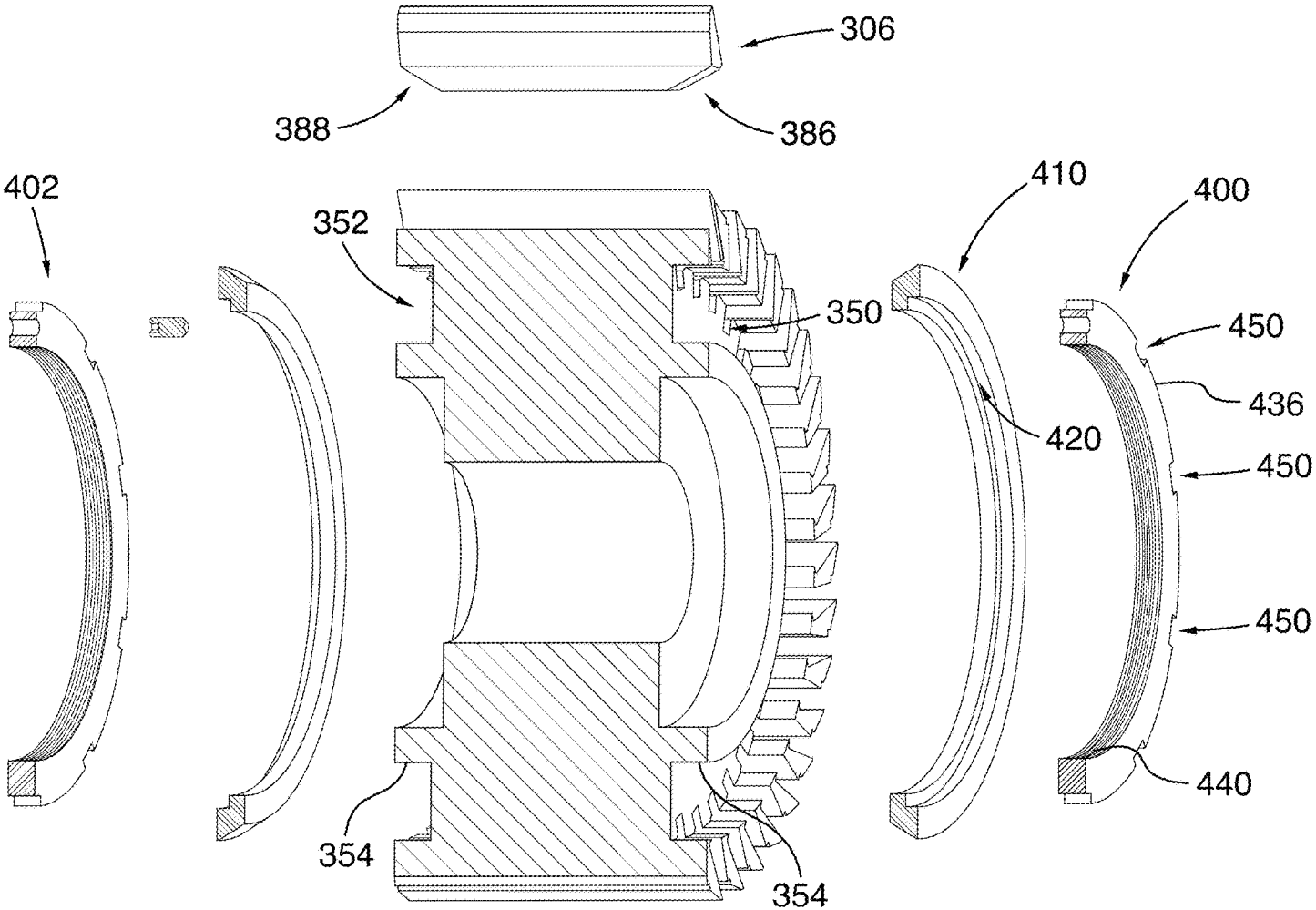
FIG. 24 is a right perspective exploded, longitudinal cross-section view of the planer head shown in FIG. 22.

As best seen in FIGS. 16 and 17, each fasteners 162 further includes a locking assembly 240. The locking assembly 240 is designed to restrict motion of the nut 258 should it become undone or loose due to vibration and centrifugal forces exerted during rotation of the planer head 100. In one embodiment, the locking assembly 240 comprises a star-shaped washer 262 integrally formed with the nut 258, and a spring loaded push rod assembly 264 mounted onto the flange 239 of the key-shaped flanged hole 238. The push rod assembly 264 includes a push rod 266 slidably engaged in a sleeve 268, the sleeve 268 being fixedly mounted to the flange 239 of the key-shaped hole 238 defined in the left ring 210 by a pair of screws 270. The push rod 266 is disposed laterally from the nut 258 so that the push rod 266 abuts a recess of the star-shaped washer 262. As the push rod assembly 264 is spring loaded, a force is exerted onto the nut 258 to prevent unwanted rotation or unscrewing thereof. It is contemplated that the washer 262 of the nut 258 could be shaped differently (i.e. having a shape other than a star shape), provided that the nut 258 includes at least one recess engageable by the push rod 266. It is also contemplated that the locking assembly 240 could be designed differently. For example, the locking assembly 240 could include a hinge lock or caps and locking fasteners. It is also contemplated that the locking assembly 240 could be omitted. The skilled addressee will appreciate that various alternative embodiments may be possible.

In the illustrated embodiment, the clamping assembly 108 is further provided with a plurality of springs 270 (best shown in FIGS. 14 and 16), designed to be sandwiched between the right and left rings 208, 210 and the annular faces 156 of the recesses 150, 152, respectively. Springs 270 are associated with corresponding fasteners 162 and are aimed at facilitating the extraction of the right and left rings 208, 210 from the right and left recesses 150, 152, when the fasteners 162 are removed. As it will be appreciated the springs 270 could be omitted. The skilled addressee will appreciate that various alternative embodiments may be possible.

Turning now to FIGS. 18 to 21B, the assembly of the planer head 100 now will be described. In a first step, knives 104 and knife holders 106 are positioned in the knife pockets 118, one knife 104 and one knife holder 106 being received in a corresponding knife pocket 118. At this stage, the knife 104 and the knife holder 106 are relatively loose in the knife pocket 118 (best shown in FIG. 21A), therefore allowing alignment of the right and left ends 194,196 of the knife 104 and knife holder 106 with the right and left ends 110, 112 of the planer head body 102. Further, the beveled faces 186, 188 of the knife holders 106 extend in the right and left recesses 150, 152, as described above (see FIG. 12).

The bolts 250 are then partially engaged in the flanged holes 224 of the right ring 208, and springs 270 are positioned along the elongated portion 254 of the bolts 250 until they abut the inner annular face 214 of the right ring 208. The threaded portion 256 of the bolts 250 is then engaged in the corresponding holes 160 of the planer head body 102, and the right ring 208 is pushed towards the body 102 until it partially engages the right recess 150 and the threaded portion 256 of the bolts 250 protrude outwardly from the annular face 156 of the left recess 152.

At this time, additional springs 270 are positioned onto the protruding portion of the bolts 250 (i.e. corresponding to the threaded portion 256), and the left ring 210 is positioned thereon. More specifically, the threaded portion 256 of each bolt 250 is engaged through a corresponding key-shaped flanged hole 238 of the left ring 210, and the left right 210 is pushed towards the body 102 until the left ring 210 partially engages the left recess 152. The nuts 258 are then engaged onto the threaded portion 256 of the bolts 250, the push rod assemblies 264 being disengaged from the star-shaped washers 262 to allow screwing of the nuts 258. At this time, the left and ring rings 208, 210 are in a distal position relative to one another and the knives 104 and knife holders 106 are still relatively loose in the knife pockets.

As the nuts 258 are screwed onto the bolts 250, the head 252 of the bolts 250 and the nuts 258 abut against the flanges 223, 239 of the corresponding flanged holes 224, 238, thereby forcing the right and left rings 208,210 to move toward one another, in a proximal position. As the rings 208, 210 move towards one another, they gradually engage the corresponding recesses 150, 152 of the body 102. As it will be appreciated, the nuts 258 are preferably screwed in a manner that will allow a gradual and uniform longitudinal movement along the circumference of the rings 208, 210 such that the rings 208, 210 do not become misaligned with respect to the corresponding recesses 150, 152.

As the rings 208, 210 move into the recesses 150, 152, the beveled faces 218, 232 of the rings 208, 210 engage the beveled faces 186, 188 of the knife holders 106, and force the knife holders 106 in a radially outward position. At this stage, the clamping assembly 108 is in a proximal position (which corresponds to the operation position of the clamping assembly 108) and the bottom face 202 of each knife 104 lies against the knife resting wall 136 of a corresponding knife pocket 118. As the knife holders 106 move outwardly, the funneled shape of the pockets 118 and the tapering shape of the knife holders 106 collaborate to push the knife holders 106 against the knives 104, the trailing face 176 of the upper portion 170 of each knife holder 106 engaging the leading face 198 of a corresponding knife 104. As the rings 208, 210 move further toward one another in the recesses 150, 152, the knife holders 106 and the leading faces 142 of the knife retaining members 138 collaborate to frictionally engage the knife 104 and simultaneously secure all the knives 104. At this point, the planer head 100 can be operated. In some embodiments, protective annular plates 113, 115 (shown in FIGS. 4 to 6 and 20A) can be secured to the assembled planer head 100 to protect the ends 110, 112 from wear and damage.

While in the above-described embodiment the leading and trailing faces 198, 200, 172, 174, 178, 140 and 142 of the knives 104, knife holders 106 and knife retaining members 138 are generally flat, it is contemplate that at least some of them could be scalloped to increase frictional engagement. Further, although the planer head 100 is being described herein as having a clamping assembly 108 comprising two annular rings 208, 210 each defining a full circumference, it is contemplated that the rings 208 could be constituted by a plurality of ring sections or segments defining together a complete ring. For instance, a ring could be constituted by three ring segments, each ring segment defining a third of the ring circumference. Further, the clamping assembly 108 could include two or more complete rings on each side. One will appreciate that many alternate embodiments are possible, where the clamping assembly is operatively connected to two or more knife holders and/or knives so that there is less clamping assemblies than there are knife holders or knives.

FIGS. 22 to 27 show another embodiment of a planer head 300. In this embodiment, the planer head 300 includes a cylindrical body 302, a plurality of knives 304 (only one knife being identified with reference numeral 304) and a corresponding plurality of knife holders 306 (only one knife holder being identified with reference numeral 306). The knives 304 and knife holders 306 have generally the same configuration that the knives 104 and knife holders 106 of the planer head 100, and therefore, reference will be made to knives 104 and knife holders 106 of the planer head 100 below, where such reference applies. Likewise, the description of the knife pockets 118 and retaining member 138 of planer head 100 apply to the below description.

The body 302 is similar to body 102 of the planer head 100. As such, elements of the body 302 will be referred to using the same last two digits of the reference numerals used for the similar elements of the body 102 but in the 300 range, while elements that are common to the body 102 and the body 302 will not be repeated. The body 302 differs mainly from the body 102 in that first inner faces 354 of the right and left annular recesses 350, 352 are threaded to collaborate with annular threaded fasteners 400, 402 of a clamping assembly 404 to secure the knives 304 to the body 302, as it will become apparent below.

With reference to FIGS. 23 to 27 the clamping assembly 404 of the planer head 300 comprises a right clamping sub-assembly 406 and a left clamping sub-assembly 408 engageable in the recesses 350, 352 of the body 302, respectively. Since the right and left clamping sub-assemblies 406, 408 are mirror images of one another, only the right clamping sub-assembly 406 will be described. It will be appreciated that a similar description also applies to the left clamping sub-assembly 408, with proper adaptation.

Figure 27:
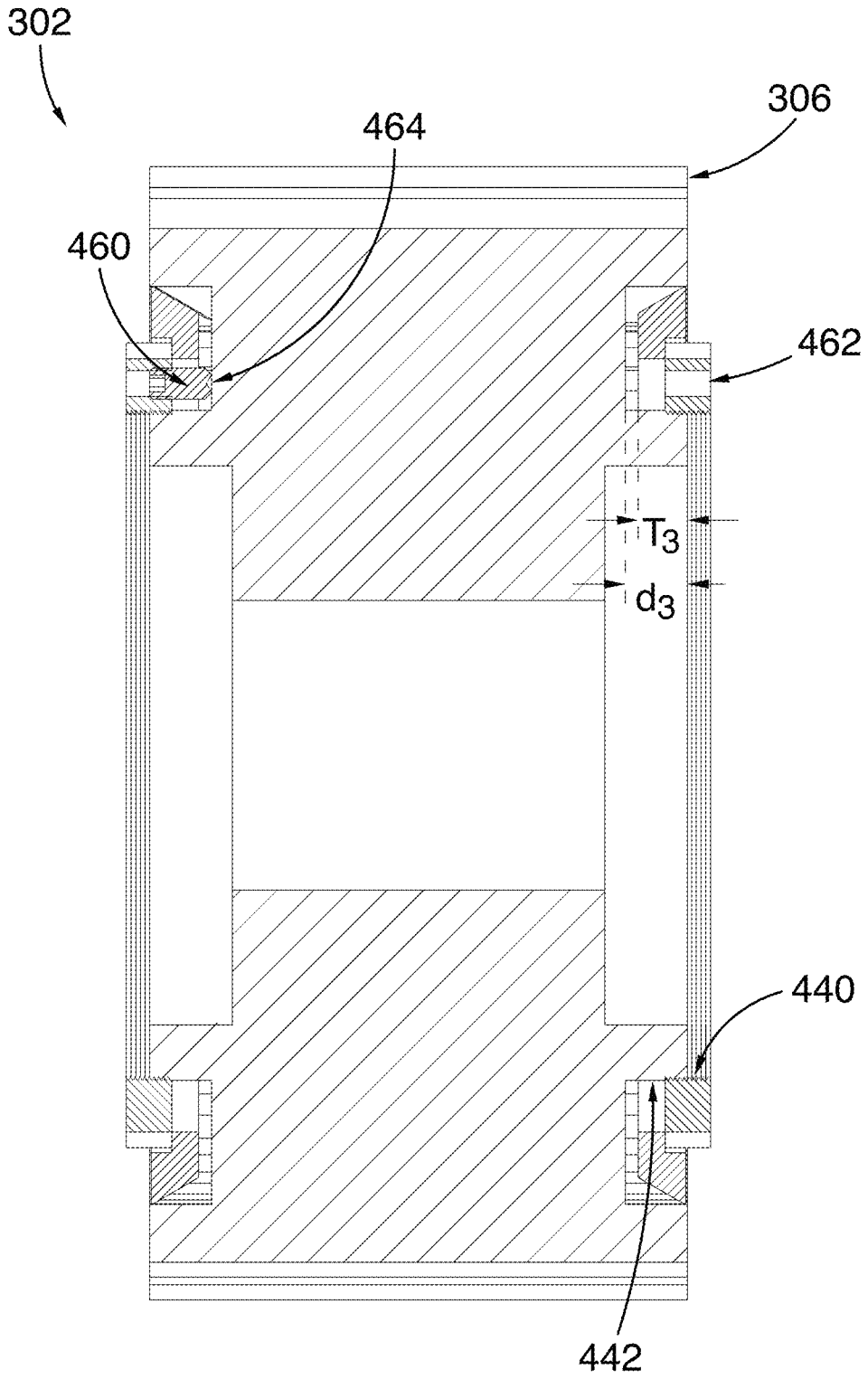
FIG. 27 is a longitudinal cross-section view of the planer head shown in FIG. 22; with the clamping assembly assembled.

The right clamping sub-assembly 406 comprises a right beveled ring 410 and the threaded annular fastener 400, which is configured to engage the right beveled ring 410 for securing the same to the body 302. The right ring 410 comprises an outer annular face 412 having a width $W_8$, an inner annular face 414 having a narrower width $W_9$ and a first curved face 416 defining an inner diameter $D_2$ of the right ring 410 and extending perpendicular to the inner annular face 414 (i.e. longitudinally or parallel to a rotation axis $R_3$). The right ring 410 also comprises a second, beveled face 418 extending between the outer and inner annular faces 412, 414. In the illustrated embodiment, the right ring 410 has a thickness $T_3$, defined between the outer annular face 412 and the inner annular face 414, which is slightly less than a depth $d_3$ of the right annular recess 350 (shown in FIG. 27). It will be understood the thickness $T_3$, defined between the outer annular face 412 and the inner annular face 414 of the ring 410 could be larger than the depth $d_3$ of the right annular recess 350 and yet, allow achieving the purpose of the embodiment. In this case, the ring 410 would engage the recess 350 only partially rather than completely, as illustrated in FIG. 27.

Defined on the outer face 412 of the right ring 410, and extending along the inner perimeter thereof, is a recess 420 sized and shaped to receive a portion of the threaded fastener 400. More specifically, the recess 420 defines an annular flange 422 onto which abuts the threaded annular fastener 400 when fasten. As one can appreciate from FIG. 26, the inner diameter $D_2$ of the right ring 410 is slightly larger than a diameter $D_3$ defined by the threaded curved face 354 of the body 302.

Figure 26:
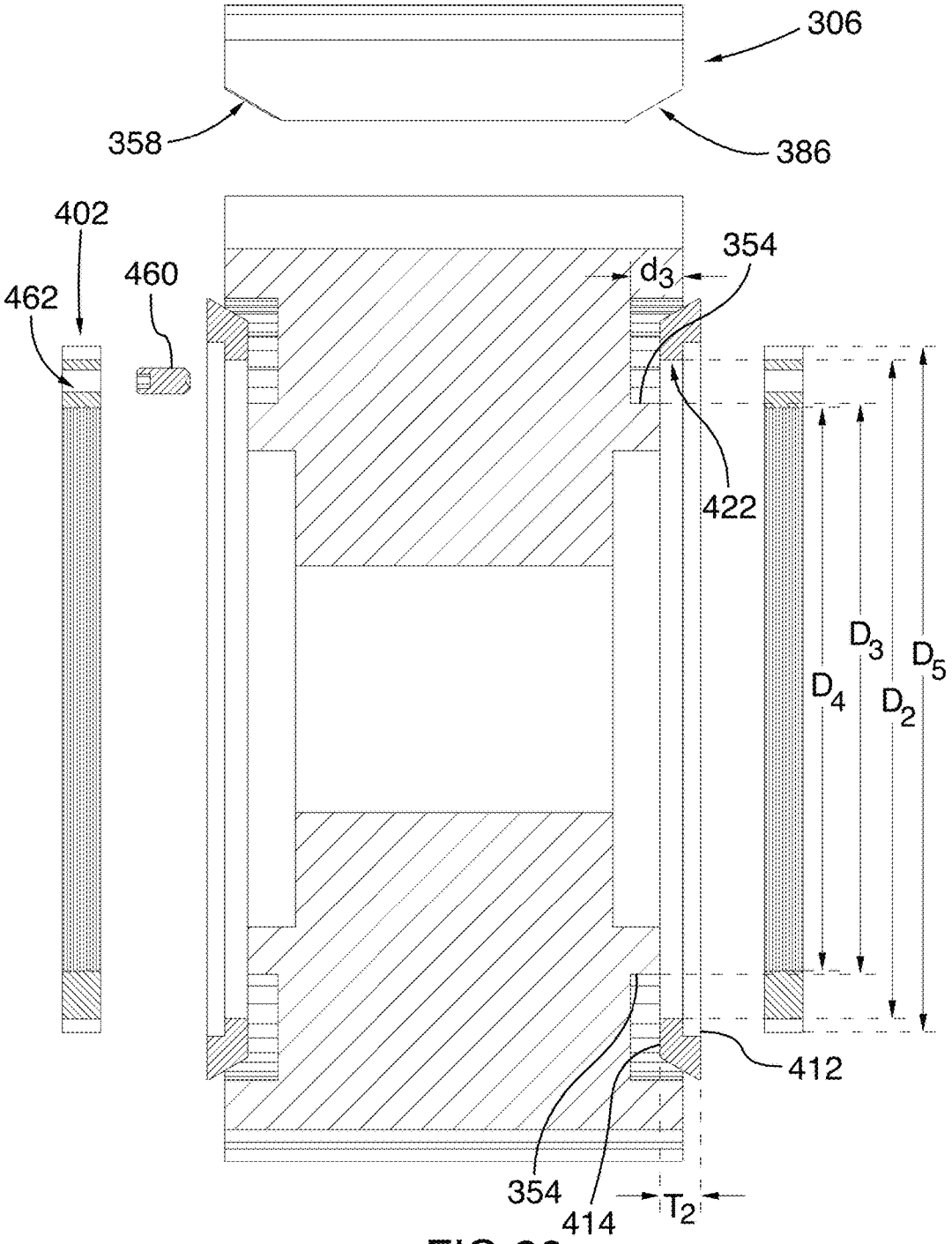
FIG. 26 is a longitudinal, exploded cross-section view of the planer head shown in FIG. 25, with the right and left rings partially engaging the right and left annular recesses.

As best shown in FIG. 26, as the right ring 410 moves into the recess 350, the beveled face 418 of the rings 410 engages the beveled face 186 of the knife holders 306, and force the knife holders 306 in a radially outward position to secure firmly secure a knife 304. To force such movement of the ring 410 into the recess 350, the annular threaded fastener 400 is screwed onto the inner curved face 354 of the body 302. The annular threaded fastener 400 has an annular outer face 430, an annular inner face 432, a curved inner face 434 defining a diameter $D_4$, and a curved outer face 436 defining a diameter $D_5$. The curved inner and outer faces 434, 436 extend parallel to one another in a longitudinal direction (i.e. parallel to the rotation axis $R_3$), perpendicular to the outer and inner annular faces 430, 432. The diameter $D_4$ defined by the inner curved face 434 corresponds to the diameter $D_3$ of the inner curved face 354 of the body 302, such that threads 440 defined on the inner curved face 434 of the threaded fastener 400 can engage the threads 442 defined on the inner curved face 354 of the body 302. The diameter $D_5$ defined by the outer curved face 436 of the annular threaded fastened 400 is adapted such that the threaded fastener 400 can be received in the annular recess 420 of the annular ring 410.

To facilitate the screwing of the annular threaded fastener 400, a plurality of crenels 450 is defined along the outer curved face 436 to receive a fastening tool. It is contemplated that the threaded fastener 400 could include only one crenel 450, or that that the crenels 450 could be omitted. Instead, the annular threaded fastener 400 could include protrusions, recesses or other design elements to facilitate screwing of the annular threaded fastener 400 onto the body 202, using tools for instance.

The planer head 300 further includes a locking bolt 460 for restricting motion of the annular threaded fastener 400 relative to the body and prevent unwanted removal of the clamping assembly 408 due to vibration and centrifugal forces during rotation of the planer head 300. In the illustrated embodiment, the bolt 460 is receivable into a bore 462 defined in the annular threaded fastener 402 (although in FIG. 27 the bolt is described in connection with threaded fastener 402, the description also applies to threaded fastener 400) and extending between the outer and inner annular faces 430, 432 thereof. Once the annular threaded fastener 400 is properly position on the body 302 of the planer head 300, the bore 462 of the threaded fastener 400 is in longitudinal alignment with a threaded hole 464 defined in the recess 350 of the body 302. As it will be appreciated, the presence of the bolt 460 extending through the bore 462 of the annular threaded fastener 400 and engaging the threaded hole 464 of the body 302 will prevent any rotational movement of the annular threaded fastener 400 relative to the body 302. In one embodiment, the bolt 460 is made of heat treated steel. The skilled addressee will appreciate that various alternative embodiments may be provided.

Figure 25:
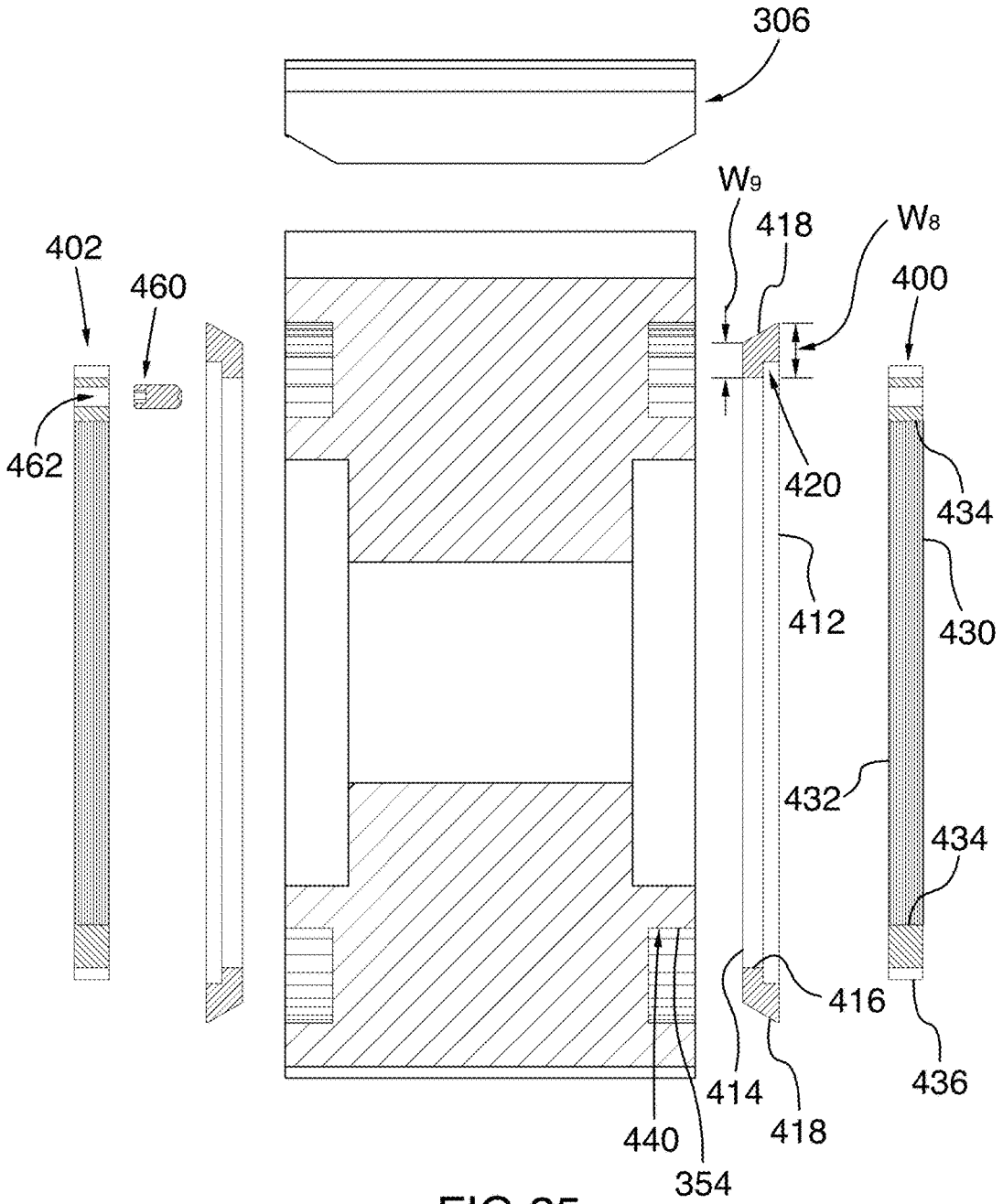
FIG. 25 is a longitudinal, exploded cross-section view of the planer head shown in FIG. 22.

Turning now to FIGS. 25 to 27, the assembly of the planer head 302 will be described. In a first step, knives 304 and knife holders 306 are positioned in the knife pockets 318, one knife 304 and one knife holder 306 being received in a corresponding knife pocket 318. At this stage, the knife holder 306 are relatively loose in the knife pocket 318, therefore allowing alignment of the right and left ends 194, 196 of the knife 304 and knife holder 306 with the right and left ends 310, 312 of the planer head body 302. Further, the beveled faces 386, 388 of the knife holders 306 extend in the right and left recesses 350, 352, as described above in connection with planer head 100.

The right and left rings 410 are pushed towards the body 302 until they partially engage the right and left recesses 350, 352, respectively. At this time, the annular threaded fasteners 400, 402 are positioned onto the body 302 such that the threads 440 of the threaded fastener 400, 402 engage the threads 442 of the body 302. At this stage, the clamping sub-assemblies 406, 408 are in a distal position relative to one another and the knife 304 and the knife holder 306 are still relatively loose in the pocket, therefore being movable therein. As the threaded fasteners 400, 402 are screwed onto the body 302, they are received in the annular recess 420 and abut against the flanges 422 of the corresponding annular rings 410 thereby forcing the right and left clamping sub-assemblies 406, 408 to move toward one another, in a proximal position. As the right and left clamping sub-assemblies 406, 408 move towards one another, they gradually engage the corresponding recesses 350, 352 of the body.

As best shown in FIGS. 26 and 27, as the clamping sub-assemblies 406, 408 move into the recesses 350, 353, toward the proximal position (i.e. a position of the clamping sub-assemblies 406, 408 corresponding to their position during operation of the planer head 300), the beveled faces 418 of the rings 410 engage the beveled faces 386, 388 of the knife holders 306, and force the knife holders 306 in a radially outward position, thereby firmly securing the knives 304 to the body 302, by frictional engagement. At this time, bolts 460 are positioned through the bore 462 of the annular fasteners 400 and 402 and screwed into threaded holes 464 of the body 302 to prevent unwanted unscrewing to the annular threaded fastener 400, 402.

Modifications and improvements to the above-described embodiments of the present may become apparent to those skilled in the art. For instance, it should be understood that the planer heads described herein could be positioned in a horizontal position, vertical position, or any angled position between a vertical position and an horizontal position to smoothen a given surface of a lumber. It should also be understood that the planer heads described herein are not limited to be used with wood lumbers, but could be used with any other surface which may require smoothing and for which the rotational cutting of an external layer of that surface would be appropriate. Likewise, the embodiments described herein could find use in cutter head provided with removable knives other than planer heads.

We claim:

1. A planer head comprising:

a cylindrical body including a first circular end, a second circular end and a curved outer face extending therebetween, the cylindrical body further including a longitudinal rotation axis extending between the first circular end and the second circular end, and at least two knife pockets defined on the curved outer face and uniformly spaced-apart from one another, each knife pocket including a first wall and a second wall, the cylindrical body further including a first annular recess on the first circular end and a second annular recess on the second circular end;

at least two knives, each knife having a connection portion received in a corresponding knife pocket and a cutting portion extending from the connection portion and projecting radially from the curved outer face of the cylindrical body;

at least two knife holders, each knife holder having first and second walls, each knife holder being received in a corresponding knife pocket such that the first wall of each knife holder is adjacent to the first wall of the knife pocket, each knife holder being movable radially within the corresponding knife pocket between an upper position in which a corresponding knife is secured in the knife pocket between the second wall of the knife holder and the second wall of the knife pocket and a lower position in which the corresponding knife is removable from the corresponding knife pocket; and a clamping assembly including first and second clamping members mounted to the first and second circular ends of the cylindrical body and movable along the longitudinal rotation axis between a proximal position in which the first and second clamping members engage the at least two knife holders to urge the at least two knife holders towards the upper position and a distal position in which the at least two knife holders are permitted to move in the lower position to release the at least two knives from the corresponding knife pockets, and a securing means for mounting the first and second clamping members to the first and second circular ends of the body and urging the first and second clamping members toward one another in the proximal position, the first and second clamping members respectively comprising first and second annular rings at least partially engaged in the corresponding first and second annular recesses, the first and second annular rings engaging the at least two knife holders and urging the same in the upper position.

2. The planer head as claimed in claim 1, wherein the cylindrical body further comprises a bore extending between the first end to the second end for mounting the body to a rotating shaft.

3. The planer head as claimed in claim 1, wherein each of the at least two knife pockets extends longitudinally between the first end and the second end of the cylindrical body.

4. The planer head as claimed in claim 1, wherein the first and second walls of each of the at least two knife pockets converge toward one another to define a funnel shape.

5. The planer head as claimed in claim 4, wherein the first and second walls of each of the at least two knife holders converge toward one another to define a generally tapering cross-section.

6. The planer head as claimed in claim 1, wherein the planer head comprises between 20 and 40 knife pockets and a corresponding number of knives and knife holders.

7. The planer head as claimed in claim 6, wherein the planer head comprises 36 knife pockets and a corresponding number of knives and knife holders.

8. The planer head as claimed in claim 1, wherein each of the first and second rings comprises an outer annular face, an inner annular face, a curved inner face and a beveled, curved outer face extending between the outer and inner annular faces, the beveled curved outer faces of the first and second annular rings engaging the at least two knife holders and urging the same in the upper position.

9. The planer head as claimed in claim 8, wherein each of the at least two knife holders comprises first and second beveled faces, the first and second beveled faces of the at least two knife holders collaborating with the beveled curved outer faces of the first and second annular rings for urging the at least two knife holders in the upper position.

10. The planer head as claimed in claim 1, wherein:

the cylindrical body comprises a plurality of bores extending between the first and second circular ends;

the first and second annular rings comprise a corresponding plurality of holes extending between the outer and inner annular faces thereof; and the fastening means of the clamping assembly comprises a corresponding plurality of bolts and nuts, each bolt being received in a corresponding bore of the cylindrical body and in corresponding holes in the first and second rings, the plurality of bolts and nuts urging the first and second rings to engage at least partially the first and second annular recesses and to engage the at least two knife holders and urging the same in the upper position.

11. The planer head as claimed in claim 1, wherein each of the first and second annular recesses of the cylindrical body comprises a threaded inner curved face and the fastening means includes first and second annular fasteners, each annular fastener comprising an inner threaded curved face engaging the threaded inner curved faces of the cylindrical body and an inner annular face engaging the outer annular face of a corresponding ring, the fastening of the first and second annular fasteners engaging the first and second rings at least partially in the corresponding recesses to engage the at least two knife holders and urging the same in the upper position.

12. The planer head as claimed in claim 1, wherein the first and second annular rings each comprises a plurality of segments.

13. A kit of a planer head assembly, the kit comprising:

a cylindrical body including a first circular end, a second circular end and a curved outer face extending therebetween, the cylindrical body further including a longitudinal rotation axis extending between the first circular end and the second circular end, and at least two knife pockets defined on the curved outer face and uniformly spaced-apart from one another, each knife pocket including a first wall and a second wall, the cylindrical body further including a first annular recess on the first circular end and a second annular recess on the second circular end;

at least two knives, each knife having a connection portion receivable in a corresponding knife pocket and a cutting portion extending from the connection portion and projecting radially from the curved outer face of the cylindrical body when the knife is received in the corresponding knife pocket;

at least two knife holders, each knife holder having first and second walls, each knife holder being receivable in a corresponding knife pocket such that the first wall of each knife holder is adjacent to the first wall of the knife pocket and such that each knife holder is movable radially within the corresponding knife pocket between an upper position in which a corresponding knife is secured in the knife pocket between the second wall of the knife holder and the second wall of the knife pocket and a lower position in which the corresponding knife is removable from the corresponding knife pocket; and a clamping assembly including first and second clamping members mountable to the first and second ends of the cylindrical body and movable along the longitudinal rotation axis between a proximal position in which the first and second clamping members engage the at least two knife holders to urge the at least two knife holders towards the upper position and a distal position in which the at least two knife holders are permitted to move in the lower position to release the at least two knives from the corresponding knife pockets, and a securing means for mounting the first and second clamping members to the first and second ends of the body and urging the first and second clamping members toward one another in the proximal position, the first and second clamping members respectively comprising first and second annular rings at least partially engageable in the corresponding first and second annular recesses for engaging the at least two knife holders and urging the same in the upper position.

14. The kit as claimed in claim 13, wherein the cylindrical body further comprises a bore extending between the first end to the second end for mounting the body to a rotating shaft.

15. The kit as claimed in claim 13, wherein each of the at least two knife pockets extends longitudinally between the first end and the second end of the cylindrical body.

16. The kit as claimed in claim 13, wherein the first and second walls of each of the at least two knife pockets converge toward one another to define a funnel shape.

17. The kit as claimed in claim 16, wherein the first and second walls of each of the at least two knife holders converge toward one another to define a generally tapering cross-section.

18. The kit as claimed in claim 13, wherein the planer head comprises between 20 and 40 knife pockets and a corresponding number of knives and knife holders.

19. The kit as claimed in claim 18, wherein the planer head comprises 36 knife pockets and a corresponding number of knives and knife holders.

20. The kit as claimed in claim 13, wherein each of the first and second rings comprises an outer annular face, an inner annular face, a curved inner face and a beveled, curved outer face extending between the outer and inner annular faces, the beveled curved outer faces of the first and second annular rings being configured to engage the at least two knife holders and urging the same in the upper position.

21. The kit as claimed in claim 20, wherein each of the at least two knife holders comprises first and second beveled faces, the first and second beveled faces of the at least two knife holders being configured to collaborate with the beveled curved outer faces of the first and second annular rings for urging the at least two knife holders in the upper position.

22. The kit as claimed in claim 13, wherein:

the cylindrical body comprises a plurality of bores extending between the first and second circular ends;

the first and second annular rings comprise a corresponding plurality of holes extending between the outer and inner annular faces thereof; and the fastening means of the clamping assembly comprises a corresponding plurality of bolts and nuts, each bolt being receivable in a corresponding bore of the cylindrical body and in corresponding holes in the first and second rings, the plurality of bolts and nuts being configured to urge the first and second rings to engage at least partially the first and second annular recesses the first and second rings and to engage the at least two knife holders and urging the same in the upper position.

23. The kit as claimed in claim 13, wherein each of the first and second annular recesses of the cylindrical body comprises a threaded inner curved face and the fastening means includes first and second annular fasteners, each annular fastener comprising an inner threaded curved face configured to engage the threaded inner curved faces of the cylindrical body, and an inner annular face configured to engage the outer annular face of a corresponding ring, the fastening of the first and second annular fasteners engaging the first and second rings at least partially in the corresponding recesses to engage the at least two knife holders and urging the same in the upper position.

24. The kit as claimed in claim 13, wherein the first and second annular rings each comprises a plurality of segments.

25. A clamping assembly for a planer head including a cylindrical body having at least two knife pockets, at least two knife holders and at least two knives receivable in the at least two knife pockets, the clamping assembly comprising:

first and second clamping members mountable to first and second circular ends of the cylindrical body and movable along a longitudinal rotation axis between a proximal position in which the first and second clamping members engage the at least two knife holders to urge the at least two knife holders towards an upper position in which the at least two knives are secured in the at least two knife pockets and a distal position in which the at least two knife holders are permitted to move in a lower position in which the at least two knives are removable from the corresponding knife pockets, the cylindrical body further including a first annular recess on the first circular end and a second annular recess on the second circular end, and the first and second clamping members respectively comprising first and second annular rings at least partially engaged in the corresponding first and second annular recesses, the first and second annular rings engaging the at least two knife holders and urging the same in the upper position; and a securing means for mounting the first and second clamping members to the first and second circular ends of the body and urging the first and second clamping members toward one another in the proximal position.

26. A cylindrical body for a planer head, the cylindrical body comprising:

a first circular end;

a second circular end;

a curved outer face extending between the first circular end and the second circular end;

a longitudinal rotation axis extending between the first end and the second end;

at least two knife pockets defined on the curved outer face and uniformly spaced-apart from one another, each knife pocket including a first wall and a second wall, each of the at least two knife pockets being sized and shaped to receive a knife holder and a knife between the knife holder and the second wall of the knife pocket and to allow movement of the knife holder in a radial direction within the knife pocket between an upper position in which a corresponding knife is secured in the knife pocket between the second wall of the knife holder and the second wall of the knife pocket and a lower position in which the corresponding knife is removable from the corresponding knife pocket; and a first annular recess defined on the first circular end and a second annular recess defined on the second circular end, the first and second annular recesses being sized and shaped to respectively receive at least partially first and second annular rings for engaging the at least two knife holders and urging the same in the upper position.

* * * * *